US006798144B2

(12) United States Patent
Mori et al.

(10) Patent No.: US 6,798,144 B2
(45) Date of Patent: Sep. 28, 2004

(54) DRIVING METHOD OF A FLAT TYPE PLASMA DISCHARGE DISPLAY DEVICE

(75) Inventors: Hiroshi Mori, Kanagawa (JP); Hironobu Abe, Kanagawa (JP)

(73) Assignee: Sony Corporation (JP)

( * ) Notice: Subject to any disclaimer, the term of this patent is extended or adjusted under 35 U.S.C. 154(b) by 400 days.

(21) Appl. No.: 09/988,334

(22) Filed: Nov. 19, 2001

(65) Prior Publication Data

US 2002/0027417 A1 Mar. 7, 2002

Related U.S. Application Data

(62) Division of application No. 09/420,799, filed on Oct. 19, 1999, now Pat. No. 6,411,033.

(30) Foreign Application Priority Data

Oct. 23, 1998 (JP) ..... P10-302713
Apr. 14, 1999 (JP) ..... P11-107070
Aug. 23, 1999 (JP) ..... P11-235780

(51) Int. Cl.[7] ..... G09G 3/10

(52) U.S. Cl. ..... 315/169.1; 315/169.4; 313/582

(58) Field of Search ..... 315/169.1, 169.3, 315/169.4; 345/41, 60, 84, 87, 66–68, 62; 313/582, 584, 585, 586, 590

(56) References Cited

U.S. PATENT DOCUMENTS 6,140,774 A * 10/2000 Mori et al. ..... 315/169.4
6,169,353 B1 1/2001 Driscoll et al. ..... 310/261
6,411,033 B1 * 6/2002 Mori et al. ..... 313/582
6,512,499 B1 * 1/2003 Abe ..... 345/60
6,603,261 B1 * 8/2003 Mori ..... 313/582

FOREIGN PATENT DOCUMENTS

| | | |
|---|---|---|
| EP | 0 580 868 A1 | 2/1994 |
| EP | 0 779 643 A2 | 6/1997 |
| EP | 0 802 556 A2 | 10/1997 |
| JP | 10-321145 | 12/1998 |
| JP | 11 126561 | 5/1999 |
| JP | 11-233024 A | 8/1999 |

* cited by examiner

*Primary Examiner*—Don Wong
*Assistant Examiner*—Jimmy T. Vu
(74) *Attorney, Agent, or Firm*—Rader, Fishman & Grauer PLLC

(57) ABSTRACT

In a flat type plasma discharge display device which includes a discharge sustaining electrode group (X) having first and second discharge sustaining electrodes and an address electrode group (Y) having address electrodes, a plurality of plasma discharge parts (P) are formed for one discharge start part thereof, and the plasma discharge parts relating to one discharge start part are driven sequentially or simultaneously to emit a light, whereby it becomes possible that plasma display of high definition and high luminance is performed in the flat type plasma discharge display device.

12 Claims, 23 Drawing Sheets

DRIVING METHOD OF A FLAT TYPE PLASMA DISCHARGE DISPLAY DEVICE

This application is a divisional Application of Ser. No. 09/420,799 filed Oct. 19, 1999, now U.S. Pat. No. 6,411,033 issued Jun. 25, 2002.

BACKGROUND OF THE INVENTION

1. Field of the Invention

The present invention relates to a flat type plasma discharge display device and its driving method.

2. Description of the Related Art

Hitherto, an alternating-current type display device utilizing a plasma discharge, or a so-called AC (alternating-current) type plasma display panel (PDP) has been known.

This AC type PDP is available in two-electrode constitution and three-electrode constitution.

An ordinary PDP in three-electrode constitution is shown in a perspective exploded view in FIG. 27, that is, as shown in this schematic structural diagram in an open state, first and second substrates 51 and 52 each made of, for example, a glass substrate are placed face to face with a specified interval through a partition wall 53 interposed between the two, and their peripheral parts are sealed with glass frit or the like, and a flat type display container is composed.

For example, on the inner surface of the first substrate 51, there are formed a scanning electrode (first discharge sustaining electrode) 54 serving also as one of the discharge sustaining electrodes and other discharge sustaining electrode (second discharge sustaining electrode) 55 (in FIG. 27, only a pair of first and second discharge sustaining electrodes corresponding to one scanning line are shown), and on the inner surface of the second substrate 52, there is formed an address electrode 56 in a direction intersecting with the scanning electrode 54 and the discharge sustaining electrode 55.

On the electrode forming surfaces of the both substrates 51 and 52, dielectric layers 57 are laminated by printing or other means, and a surface protective layer 58 made of MgO or the like is formed further on the surface thereof.

On the second substrate 52, for example, a fluorescent material 59 for emitting a visible light by ultraviolet rays generated by discharge is coated.

The flat display container formed by the first and second substrates 51 and 52 is filled air-tightly with a gas suited to the discharge.

A driving circuit is connected to each electrode, and a discharge is generated in the space enclosed by the substrates 51 and 52 and the partition wall 53, and by the ultraviolet rays generated by this discharge, the fluorescent material 59 is excited to emit a light, and a target or intended display is made.

The voltage waveform for driving such a PDP is schematically shown in FIG. 9. This driving is divided into a "scanning discharge period" for determining a pixel for causing an ordinary discharge, and a "sustained discharge period" for sustaining the discharge of the thus determined pixel.

First, in the scanning discharge period, when scanning the pixel desired to be discharged, a voltage equal to or higher than a discharge start voltage is applied between the scanning electrode 54 and the address electrode 56 at a position corresponding to the pixel. As a result, the pixel at this position is set in discharge start state, and hence the discharge pixel is selected. This selection is made for each one of a plurality of address electrodes for one scanning electrode. That is, the same number of pixels as the number of address electrodes can be driven independently.

Therefore, by scanning a plurality of scanning electrodes sequentially by each scanning line and changing over the voltage of the address electrode 56 every time according to the image desired to be displayed, all pixels for composing one screen can be controlled.

Next, in the sustained discharge period, between the scanning electrode 54 and the discharge sustaining electrode 55, an AC voltage waveform called a discharge sustaining voltage is applied. At this time, as to the pixel once applied with the voltage equal to or higher than the discharge start voltage in the scanning discharge period, its discharge is sustained thereafter only by application of discharge sustaining voltage, and the luminous display continues. This is a so-called memory effect.

FIG. 9 shows the driving waveform for displaying about one address electrode 56.

FIG. 9A shows the display signal waveform applied to this one address electrode 56, and in this case, for example, the pixels positioned at the intersections with the first, second and fourth horizontal scanning lines are discharged or turned on, and in this case, a specified ON voltage Va is supplied in sections $\tau_1$, $\tau_2$, $\tau_4$.

On the other hand, in each scanning electrode 54 corresponding to each horizontal scanning line, as shown in FIG. 9$B_1$, $B_2$, $B_3$ . . . , to the scanning electrodes 54 adjacent in the vertical direction, a specified ON voltage Vb of reverse polarity to the voltage Va is changed over and applied sequentially in sections $\tau_1$, $\tau_2$, $\tau_3$, $\tau_4$ . . . At this time, to the discharge sustaining electrode 55 making a pair with each scanning electrode 54, no voltage is applied as shown in FIG. 9C.

In the next sustained discharge period, in each horizontal scanning line, pulse voltages shown in FIGS. 9$B_1$, $B_2$, $B_3$ . . . and C are applied to the scanning electrodes 54 and the confronting discharge sustaining electrodes 55.

When such driving waveforms are applied to the respective electrodes, as shown in FIG. 9$D_1$, $D_2$, $D_3$ . . . , in the scanning discharge period, a voltage of Va+Vb is selectively applied in section $\tau_1$ between the scanning electrode 54 and one address electrode 56 in the first horizontal scanning line, in section $\tau_2$ between the scanning electrode 54 and one address electrode 56 in the second horizontal scanning line, and, although not shown, in section $\tau_4$ between the scanning electrode 54 and one address electrode 56 in the fourth horizontal scanning line.

At this time, by preliminarily selecting the Va+Vb equal to or higher than the aforesaid discharge start voltage, and selecting the individual voltages Va and Vb at a voltage not reaching the discharge start voltage, the discharge start state, that is, the ON state is established only for the pixels at the intersection with the address electrode 54 in the selected first, second and fourth horizontal scanning lines.

The pixels once turned on are kept in discharge state in the subsequent sustained discharge period as the desired AC voltage shown in FIG. 9E is applied sequentially between each scanning electrode and the discharge sustaining electrode.

Thus, discharge, that is, luminescence about the entire screen, that is, all pixels can be controlled by display signals, and the target or intended image can be displayed.

In the display devices recently advanced remarkably, such as a personal computer, an office work station, a wall-hang television receiver, a large-screen television receiver or the like, there is an increasing demand for higher definition, higher luminance and lower power consumption. In the trend of larger screen, at the same time, there are problems in power consumption and response due to increase in the electrode resistance.

In order to solve such problems, the present applicant formerly proposed a flat type plasma discharge display device, for example, in Japanese Patent Application No. 10-32974 and Japanese Patent Application No. 10-37546.

In these proposed display devices, it is possible to narrow the interval between a pair of discharge sustaining electrodes for discharge sustaining or the interval between the discharge sustaining electrode and a discharge start address electrode, so that the discharge mode may be substantially realized by a cathode glow discharge. Thus, by narrowing the interval between the electrodes, a higher definition is realized, and it is further possible to improve characteristics of cathode glow discharge, such as higher luminance and lower power consumption.

In the display device disclosed in Japanese Patent Application No. 10-32974 and Japanese Patent Application No. 10-37546 mentioned above, by arranging and forming the discharge sustaining electrode group and the address electrode group on a common substrate side, mutual positioning therebetween and manufacture thereof are facilitated.

That is, in this flat type plasma a discharge display device, for example, as an open schematic perspective view thereof is shown in FIG. 28, first and second substrates 1 and 2 are placed face to face across a specified interval, and the peripheral parts thereof are fritted and sealed to compose an airtight sealed flat display container, and this container is packed with a discharge gas.

As its essential parts are shown in a schematic plan view in FIG. 29, on the common first substrate 1, a discharge sustaining electrode group X and an address electrode group Y are formed.

The discharge sustaining electrode group X is formed of plurality of pairs of first discharge sustaining electrodes $X_A$ ($X_{A-1}$, $X_{A-2}$, $X_{A-3}$ . . . ) and second discharge sustaining electrodes $X_B$ ($X_{B-1}$, $X_{B-2}$, $X_{B-3}$ . . . ) disposed which are respectively extended in one direction, and the address electrode group Y is flatly formed of a plurality of address electrodes $Y_1$, $Y_2$, $Y_3$ . . . formed along the direction intersecting with the discharge sustaining electrodes $X_A$ ($X_{A-1}$, $X_{A-2}$, $X_{A-3}$ . . . ) and $X_B$ ($X_{B-1}$, $X_{B-2}$, $X_{B-3}$ . . . ). Insulating layers 14 are interposed at least in the intersections of these first and second discharge sustaining electrodes $X_A$ ($X_{A-1}$, $X_{A-2}$, $X_{A-3}$ . . . ) and $X_B$ ($X_{B-1}$, $X_{B-2}$, $X_{B-3}$ . . . ), and the address electrodes $Y_1$, $Y_2$, $Y_3$ . . . of the address electrode group Y.

To each of the address electrodes $Y_1$, $Y_2$, $Y_3$ . . . , discharge start address electrodes C disposed on the substrate 1 are electrically coupled such that with respect to each pair of first and second discharge sustaining electrodes $X_A$ and $X_B$, they oppose to each first discharge sustaining electrode $X_A$ with a specified narrow interval.

FIG. 30 is a schematic electrode configuration showing the relation among the first and second discharge sustaining electrodes $X_A$ ($X_{A-1}$, $X_{A-2}$, $X_{A-3}$ . . . ) and $X_B$ ($X_{B-1}$, $X_{B-2}$, $X_{B-3}$ . . . ), the address electrodes Y ($Y_1$, $Y_2$, $Y_3$ . . . ), and discharge start address electrodes C thereof.

SUMMARY OF THE INVENTION

The invention, relating to the flat type plasma discharge display device such as the display device as mentioned above, is intended to present a flat type plasma discharge display device and its driving method capable of enhancing the luminance or facilitating the driving circuit.

In the flat type plasma a discharge display device of the invention, a discharge sustaining electrode group arranging a plurality of discharge sustaining electrodes, and an address electrode group arranging a plurality of address electrodes are formed on a common substrate or on mutually different substrates.

A plurality of plasma discharge parts are formed for one discharge start part by the address electrodes, and the interval between each pair of discharge sustaining electrodes in discharge sustaining relating to each plasma discharge part is set equal to or less than 50 $\mu$m, and the plasma discharge display is realized mainly by the cathode glow discharge.

In the driving method of flat type plasma a discharge display device of the invention, in the flat type plasma a discharge display device having such constitution, a target or intended display is made in a discharge start state between the address electrode of the discharge start part relating to the selected plasma discharge part and the discharge sustaining electrode.

Also in the driving method of flat type plasma a discharge display device of the invention, in the above-mentioned driving method, in making of such intended display, as the driving method for forming one screen by first and second fields, in the first field, a display is made by a part of plasma discharge parts corresponding to each discharge start part, and in the second field, a display is made by the other plasma discharge parts corresponding to each discharge start part.

Further, in the driving method of flat type plasma a discharge display device of the invention, in the driving method mentioned above, in making of such intended display, the intended display is made by driving and displaying a plurality of plasma discharge parts corresponding to the discharge start parts simultaneously.

In the flat type plasma a discharge display device of the invention, a discharge sustaining electrode group arranging a plurality of discharge sustaining electrodes, and an address electrode group arranging a plurality of address electrodes individually having a discharge start address electrode are formed on a common substrate, the discharge sustaining electrodes and the address electrodes are disposed so as to intersect through an insulating layer, and a plurality of plasma discharge parts are formed for each one of the discharge start address electrodes.

In the driving method of flat type plasma a discharge display device of the invention, the driving method is basically same as each of the driving method mentioned above.

Moreover, in the flat type plasma a discharge display device of the invention, a first substrate and a second substrate are placed to face each other while keeping a specified interval therebetween, a discharge sustaining electrode group formed by arranging a plurality of discharge sustaining electrodes is formed at the first substrate side, an address electrode group formed by arranging a plurality of address electrodes is formed at the second substrate side, a plurality of plasma discharge parts are formed in one discharge start part of the address electrodes, and the interval between the discharge sustaining electrodes forming a pair in discharge sustaining relating to the plasma discharge part is set equal to or less than 50 $\mu$m, and plasma discharge display is made mainly by cathode glow discharge.

In the driving method of flat type plasma a discharge display device of the invention, too, the driving method is basically same as each of the driving method mentioned above.

Also, in the flat type plasma a discharge display device of the invention, a first substrate and a second substrate are place to face each other while keeping a specified interval therebetween, a discharge sustaining electrode group formed by arranging a plurality of discharge sustaining electrodes is formed at the first substrate side, an address electrode group formed of a plurality of partition walls extended in a direction intersecting with the main extending direction of the discharge sustaining electrodes while keeping a specified interval, and a plurality of address electrodes arranged and formed on each one of the partition walls along the extending direction of the partition walls is formed at the second substrate side, a plurality of plasma discharge parts are formed in one discharge start part of the address electrodes, and the interval between discharge sustaining electrodes forming a pair in discharge sustaining relating to the plasma discharge part is set equal to or less than 50 $\mu$m, and plasma discharge display is realized mainly by cathode glow discharge.

In the driving method of flat type plasma a discharge display device of the invention, too, the driving method is basically same as each of the driving method mentioned above.

Thus, according to the invention, as described above, since a plurality of plasma discharge parts are formed for one discharge start part, that is, one address electrode or discharge start address electrode, the number of address electrodes or discharge start address electrodes may be decreased, and the area is reduced, so that the number of pixels, that is, the number of plasma discharge parts can be increased within the same area while keeping a sufficient width of the electrode pixel.

In its driving, as will be clear from the description given later, it is possible to drive the flat type plasma display device without using any particular signal processing circuit or the like.

By simultaneously turning on and off the plurality of plasma discharge parts, it is intended to display at high luminance.

DETAILED DESCRIPTION OF THE PREFERRED EMBODIMENTS

Figure 1:
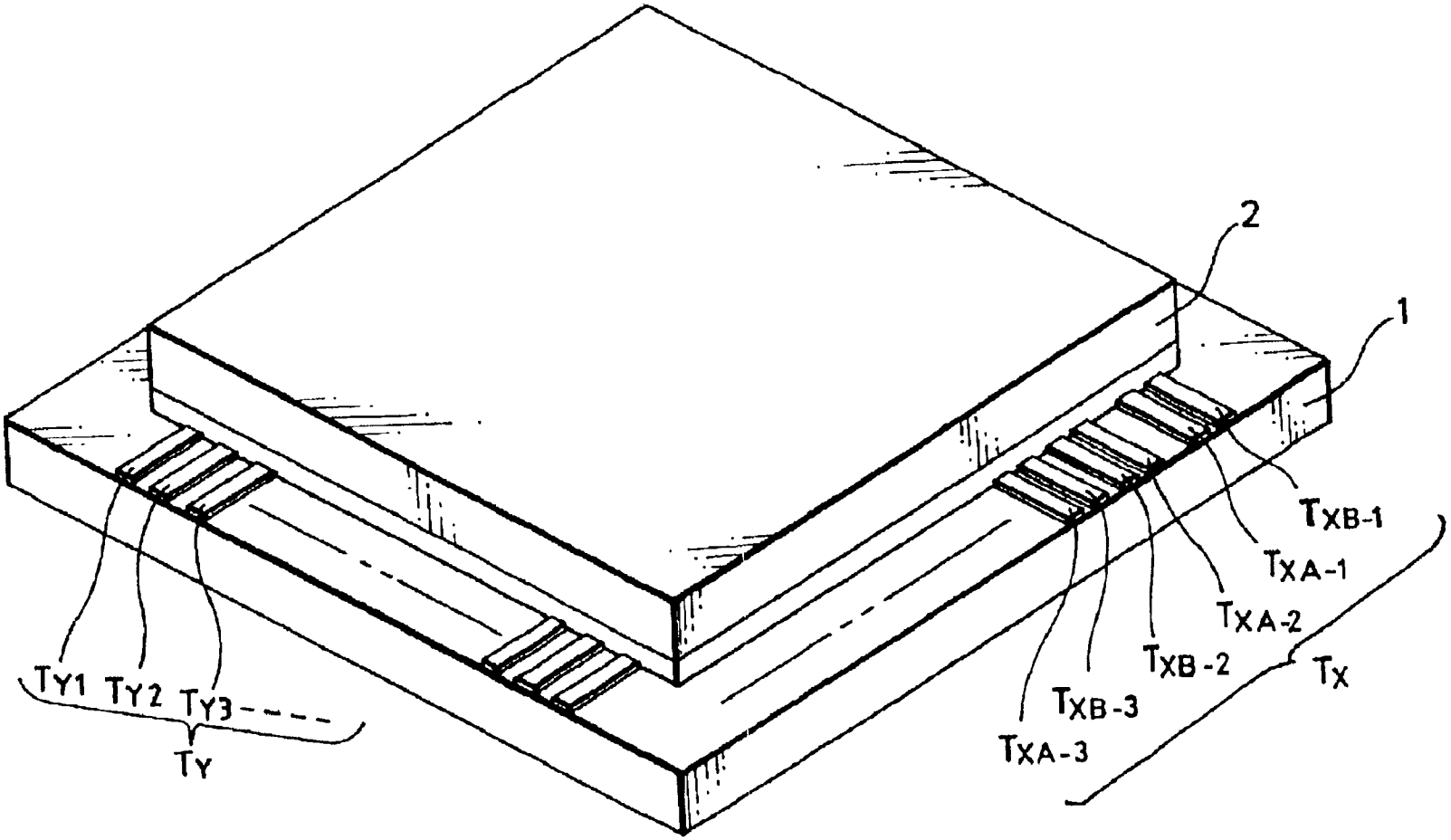
FIG. 1 is a perspective view of an example of a flat type plasma a discharge display device according to the invention.

An embodiment of a flat type plasma a discharge device according to the present invention (first embodiment) is described below.

[First Embodiment]

In this embodiment, first and second substrates are provided face to face, and their peripheral parts are fritted and sealed to compose a flat type display container.

On a common substrate, for example, on the first substrate for composing the flat type display container, a discharge sustaining electrode group formed by arranging parallel a plurality of discharge sustaining electrodes, and an address electrode group formed by arranging parallel a plurality of address electrodes each being connected with discharge start address electrodes are formed.

The discharge sustaining electrodes are extended in one direction, for example, in a horizontal direction and arranged parallel, and the address electrodes are formed, for example, in a vertical direction intersecting with the discharge sustaining electrodes, and insulating layers are interposed, at least, in the intersections of these discharge sustaining electrodes and the address electrodes to be disposed flatly.

The discharge start address electrodes are connected and arranged at the side of the address electrodes, for example, in a plurality while keeping a specified interval therebetween.

For each address electrode, a plurality of, for example, two plasma discharge parts are formed. For example, the discharge sustaining electrodes are arranged such that in order to form plasma discharge parts, first and second discharge sustaining electrodes of each pair are disposed at both sides by commonly sandwiching each discharge start address electrode disposed on the corresponding horizontal line. That is, in this case, between the adjacent discharge start address electrodes in the extended direction of the address electrode, two pairs, that is, two sets of pair of discharge sustaining electrodes are arranged.

Alternatively, between the adjacent discharge start address electrodes in the extended direction of the address electrode mentioned above, three discharge sustaining electrodes are arranged, and using commonly the central discharge sustaining electrode of the three discharge sustaining electrodes, a pair of discharge sustaining electrodes may be formed by combination of this discharge sustaining electrode and the discharge sustaining electrodes at both sides thereof, so that two plasma discharge parts are composed for each discharge start address electrode.

A partition insulating layer is disposed between the adjacent discharge start address electrodes in the extended direction of the address electrode.

This partition insulating layer is disposed at least between the pair of discharge sustaining electrodes when two sets of discharge sustaining electrodes are disposed between the above-said adjacent discharge start address electrodes, and the thickness of the partition insulating layer between these two sets of discharge sustaining electrodes is equal to their distance or higher (thicker).

This partition insulating layer may be composed of a same insulating layer simultaneously with the insulating layer interposed between the discharge sustaining electrode and address electrode mentioned above.

On the electrode forming area of the first substrate, for example, a dielectric layer is formed on the entire area thereof.

The thickness of this dielectric layer is preferred to be smaller than the distance between the electrodes, that is, the distance between the pair of first and second discharge sustaining electrodes, and the distance between the first discharge sustaining electrode and the discharge start address electrode.

On the surface of the dielectric layer, a surface layer having both a function of protective layer having sputtering resistance property and a function of lowering the work function and made of, for example, magnesium oxide MgO, may be formed.

On the other hand, on the second substrate, for example, a fluorescent layer emitting a light by excitation by ultraviolet rays (vacuum ultraviolet rays) generated by the plasma discharge may be formed.

For example, when observing the luminous display from the first substrate side, this first substrate is a transparent substrate capable of transmitting therethrough the display light. In this case, a reflective film is formed at the second substrate side, so that a luminous display of high luminance is presented from the first substrate side. That is, for example, a reflective film can be formed between the other substrate and the fluorescent layer.

Or, forming a reflective film at the first substrate side, it may be also constituted to observe from the second substrate side.

As the reflective film, a high reflectivity material such as aluminum (Al), nickel (Ni), silver (Ag), other metal film or the like may be used.

An interval Ds between the first and second discharge sustaining electrodes forming a pair in discharge sustaining of the discharge sustaining electrode group is set at less than 50 $\mu$m, 30 $\mu$m or less, or preferably 20 $\mu$m or less, 5 $\mu$m or less, or 1 $\mu$m or less, that is, a narrow gap mainly for generating the cathode glow discharge, that is, generating the cathode grow discharge dominantly.

An interval d between the discharge start address electrode and the discharge sustaining electrode for starting the discharge therebetween (hereinafter called the first discharge sustaining electrode) is either set at the gap for generating the cathode glow discharge dominantly same as above, at the gap equal to or similar to the interval between the discharge sustaining electrodes, or selected at a gap for generating, for example, a negative glow discharge dominantly, for example, 100 $\mu$m or 70 $\mu$m.

The flat type display container is packed with a sealing gas, for example, at least one type of gas selected from He, Ne, Ar, Xe, and Kr, for example, a so-called Penning gas of mixture of Ne and Xe, at atmospheric pressure of 0.05 to 5.0, for example.

The discharge sustaining electrode is formed of a metal film, for example, a single layer of transparent conductive film, or made of Al, Cr, Au, Ag or the like, a two-layer film structure of Al/Cr by combining them, a three-layer film structure of Cr/Al/Cr or the like.

The discharge start address electrode, when forming simultaneously with the discharge sustaining electrode group, may be formed of the same material as the discharge sustaining electrode group, or when forming simultaneously with the address electrodes, may be formed of same composition as the address electrodes, such as Al, Ag or other metal material.

The display device according to the present invention is applicable to both a color display device and a monochromatic display device.

In the case of color display device, one pixel is composed of a set of, for example, red, green and blue unit discharge regions (so-called dots), while in the case of monochromatic display device, one pixel is composed of one unit discharge region (dot).

Referring now to FIG. 1 to FIG. 8, an embodiment according to the present invention is described below, but it must be noted that the invention is not limited to the illustrated example alone.

Figure 2:
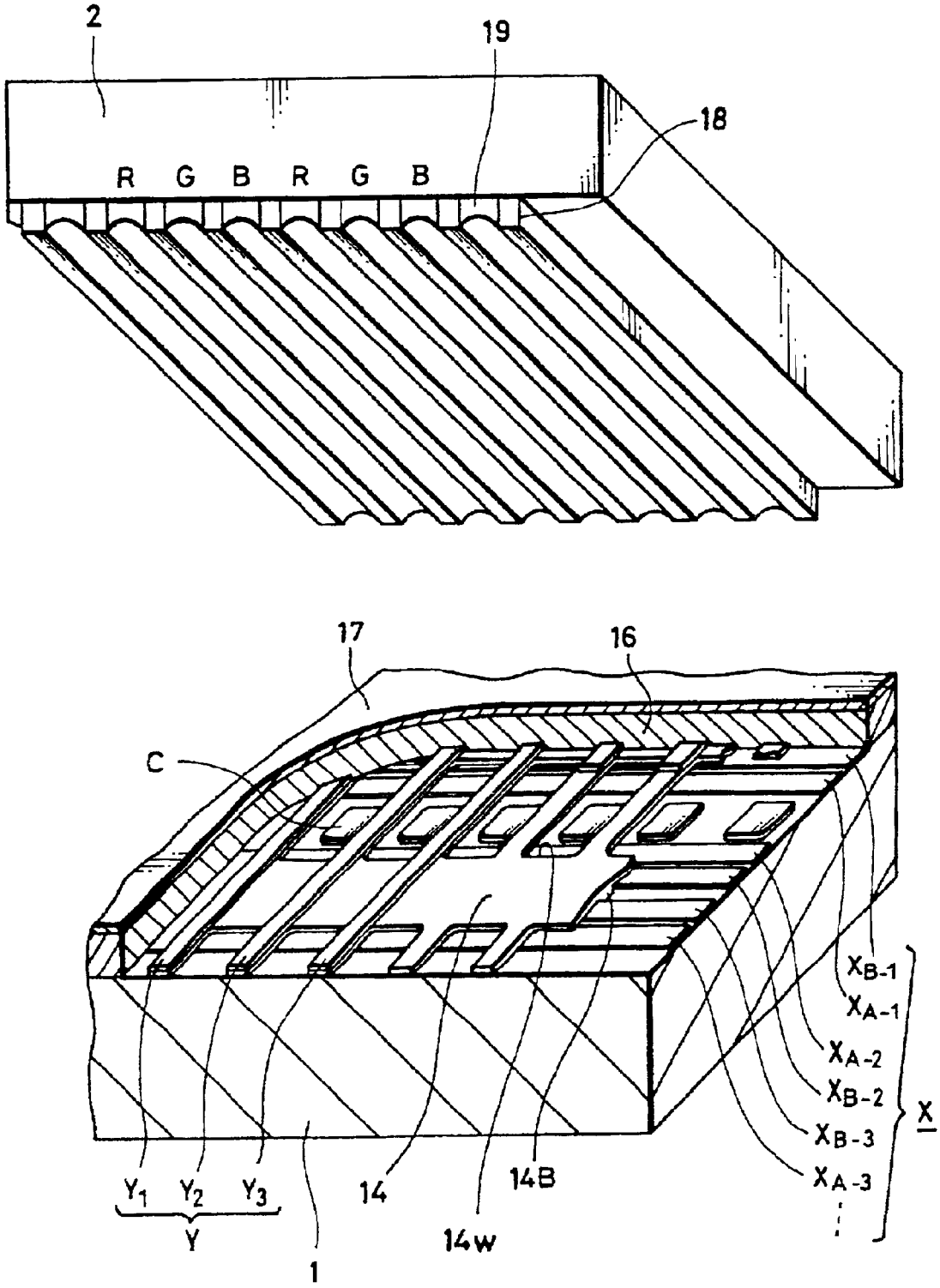
FIG. 2 is a partially cut-away essential perspective open view of the example of flat type plasma a discharge display device according to the present invention.

FIG. 1 is a schematic perspective view showing an example of the embodiment of the flat type plasma a discharge display device according to the present invention, and FIG. 2 is a partially cut-way exploded perspective view of its essential parts.

In this display device, first and second substrates 1 and 2 each made of, for example, a glass substrate are placed face to face with a specified interval therebetween, and their peripheral parts are fritted and sealed air-tightly, and a flat display container is formed in which a flat space is defined between the both substrates 1 and 2.

At least one of the first and second substrates 1 and 2, for example, the first substrate 1 is made of a transparent substrate for transmitting therethrough a display light, and the luminous display is observed from this first substrate 1.

This space is packed with discharge gas as mentioned above, for example, at least one type of gas selected from He, Ne, Ar, Xe, and Kr, for example, a so-called Penning gas of mixture of Ne and Xe.

Figure 3:
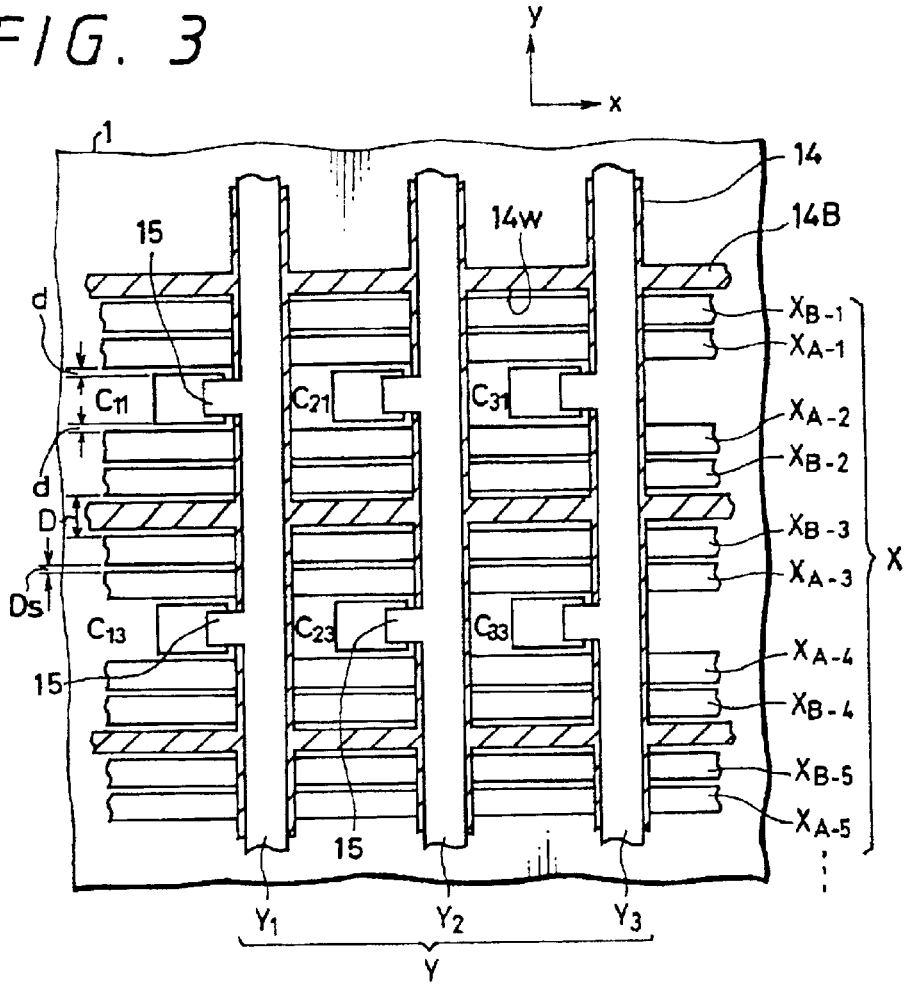
FIG. 3 is a plan view showing a state of forming electrodes on a common substrate of the flat type plasma a discharge display device according to the present invention.

As a plan view is shown in FIG. 3 and an electrode layout is shown schematically in FIG. 3, on the first substrate 1, a plurality of sets of first discharge sustaining electrodes $X_A$ ($X_{A-1}$, $X_{A-2}$, $X_{A-3}$ . . . ) and second discharge sustaining electrodes $X_B$ ($X_{B-1}$, $X_{B-2}$, $X_{B-3}$ . . . ) making each pair, which are formed in a band form extending in one direction, for example, horizontal direction (x-direction), are arranged parallel with the specified interval $D_S$ mentioned above to compose the discharge sustaining electrode group X.

Figure 4:
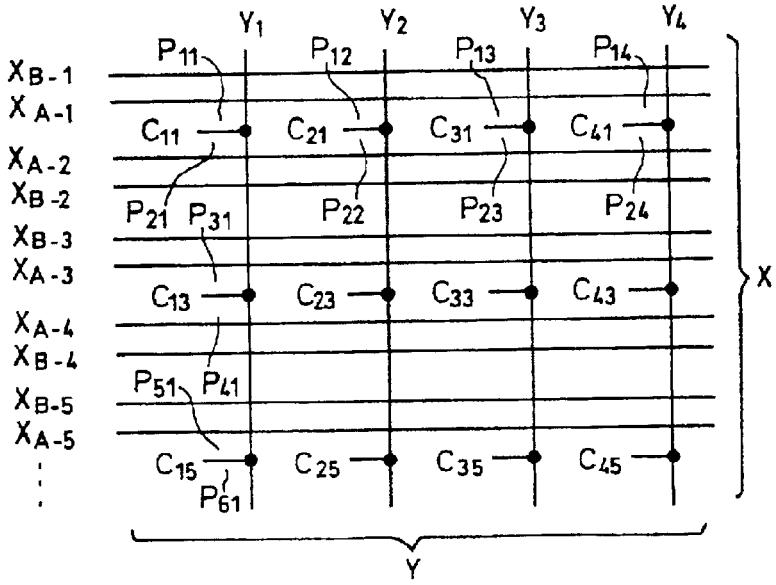
FIG. 4 is a schematic electrode layout diagram of the flat type plasma a discharge display device according to the present invention.

In the arrangement or configuration of this discharge sustaining electrode group X, discharge sustaining electrodes of mutually adjacent other pairs are arranged so that the first discharge sustaining electrodes $X_A$ may face each other and that the second discharge sustaining electrodes $X_B$ may face each other. That is, in each pair of discharge sustaining electrodes $X_{A-1}$ and $X_{B-1}$, $X_{A-2}$ and $X_{B-2}$, $X_{A-3}$ and $X_{B-3}$ . . . , as shown in FIG. 3 and FIG. 4, they are arranged so that the first discharge sustaining electrodes $X_{A-1}$ and $X_{A-2}$ may be adjacent to each other, the second discharge sustaining electrodes $X_{B-2}$ and $X_{B-3}$, may be adjacent to each other, the first discharge sustaining electrodes $X_{A-3}$ and $X_{A-4}$, may be adjacent to each other, and so forth.

Across the first and second discharge sustaining electrodes $X_A$ ($X_{A-1}$, $X_{A-2}$, $X_{A-3}$ . . . ) and $X_B$ ($X_{B-1}$, $X_{B-2}$, $X_{B-3}$ . . . ) of the discharge sustaining electrode group X, address electrodes Y ($Y_1$, $Y_2$, $Y_3$ . . . ) of parallel electrodes in a band form extending in other direction, for example, vertical direction (y-direction) are formed between the intersections of the electrodes $X_A$ ($X_1$, $X_{A-2}$, $X_{A-3}$ . . . ) and $X_B$ ($X_{B-1}$, $X_{B-2}$, $X_{B-3}$ . . . ) through an insulating layer 14.

A discharge start address electrode C disposed at one side, or left side in the example shown in FIG. 3, of each of the address electrodes Y ($Y_1$, $Y_2$, $Y_3$ . . . ) one each for two adjacent sets of pair of discharge sustaining electrodes is connected electrically to each address electrode.

In this case, in order to face the electrodes $X_A$ ($X_{A-1}$, $X_{A-2}$, $X_{A-3}$, $X_{A-4}$ . . . ) with the specified distance d, the discharge start address electrodes C or $C_{11}$, $C_{13}$, $C_{15}$, . . . , $C_{21}$, $C_{23}$, $C_{25}$ . . . , $C_{31}$, $C_{33}$, $C_{35}$ . . . are disposed between the first discharge sustaining electrodes $X_A$ of the adjacent two pairs of discharge sustaining electrodes, that is, between $X_{A-1}$ and $X_{A-1}$, $X_{A-3}$ and $X_{A-4}$ . . . . In other words, two pairs of discharge sustaining electrodes $X_A$ and $X_B$, that is, four discharge sustaining electrodes are disposed between the discharge start address electrodes C (between $C_{11}$ and $C_{13}$, $C_{13}$ and $C_{15}$ . . . , $C_{21}$ and $C_{23}$, $C_{23}$ and $C_{25}$ . . . ).

Thus, as shown in FIG. 4, between each discharge start address electrode C and the two sets of discharge sustaining electrodes opposing on both sides to sandwith the same, a pair of plasma discharge parts P are formed ($P_{11}$, and $P_{21}$, $P_{31}$ and $P_{41}$, $P_{51}$ and $P_{61}$ . . . , $P_{12}$ and $P_{22}$ . . . ). That is, for the discharge start part of each discharge start address electrode C, each pair of plasma discharge parts P are formed.

Terminals $T_X$ ($T_{XA-1}$, $T_{XA-2}$, $T_{XA-3}$ . . . , and $T_{XB-1}$, $T_{XB-2}$, $T_{XB-3}$ . . . ) extended from one end each of the discharge sustaining electrodes $X_A$ of the discharge sustaining electrode group $X_A$ ($X_{A-1}$, $X_{A-2}$, $X_{A-3}$ . . . ) and $X_B$ ($X_{B-1}$, $X_{B-2}$, $X_{B-3}$ . . . ) are led to one side or mutually confronting two sides of the first substrate 1 projected from the second substrate 2 as shown in FIG. 1, and terminals $T_Y$ ($T_{Y1}$, $T_{Y2}$, $T_{Y3}$ . . . ) extended from one end each of the address electrodes Y ($Y_1$, $Y_2$, $Y_3$ . . . ) are similarly led to one side of mutually confronting two sides of the substrate 1.

Between two sets of discharge sustaining electrodes pairing each other without intervening the discharge start address electrodes therebetween, that is, between the second discharge sustaining electrodes $X_B$, in the illustrated example, between $X_{B-2}$ and $X_{B-3}$, $X_{B-4}$ and $X_{B-5}$ . . . , the interval D is defined in the relation of D>d, and a partition insulating layer 14B of which height (thickness) is equal to or higher (thicker) than this distance D is interposed between them. This partition insulating layer 14B and the insulating layer 14 placed between the discharge sustaining electrode and the address electrode mentioned above may be simultaneously formed by the same insulating layer.

Thus, by interposing the partition insulating layer 14B between other set of mutually adjacent discharge sustaining electrodes without intervening the discharge start address electrode C, the risk of occurrence of abnormal discharge between other plasma discharge parts P can be securely avoided.

On the second substrate 2, as shown in FIG. 2, opposite to the address electrodes Y ($Y_1$, $Y_2$, $Y_3$ . . . ) extending in the y-direction, a partition wall 18 in a band form is formed along the same. This partition wall 18 serves to prevent the mutual crosstalk in each unit discharge region, that is, each plasma discharge part P.

Further, on the second substrate 2, a fluorescent layer 19 for emitting a visible light by ultraviolet rays (vacuum ultraviolet rays) generated by the plasma discharge is formed. For example, in the case of color display, fluorescent materials R, G, B for emitting red, green and blue lights are coated between the partition walls 18 in specified sequence and arrangement.

In a selected plasma discharge part P of thus arranged plasma discharge parts P, as specifically described below, by discharging selectively by applying a specified voltage between the discharge start address electrode C and the confronting specified first discharge sustaining electrode $X_A$, and successively between the first and second discharge sustaining electrodes $X_A$ and $X_B$, the specified area of the fluorescent layer 19 is illuminated to make a target or intended display.

In the AC driving, covering over the address electrode Y at least including the discharge sustaining electrode group X and the discharge start address electrodes C, a dielectric layer 16 made of, for example, $SiO_2$ is formed on the entire area except for the terminal leading-out portions.

On this dielectric layer 16, a surface layer 17 made of, for example, MgO is formed, which is smaller in work function than the dielectric layer 16 and protects the surface of the dielectric layer 16 from damage due to the discharge plasma.

For the ease of understanding of the display device having such constitution, an example of its manufacturing method is described below. In this example, the first and second discharge sustaining electrodes $X_A$ ($X_{A-1}$, $X_{A-2}$, $X_{A-3}$ . . . ) and $X_B$ ($X_{B-1}$, $X_{B-2}$, $X_{B-3}$ . . . ) of the discharge sustaining electrode group, and the discharge start address electrodes C are formed of the same conductive layer, that is, by the same process.

Figure 5:
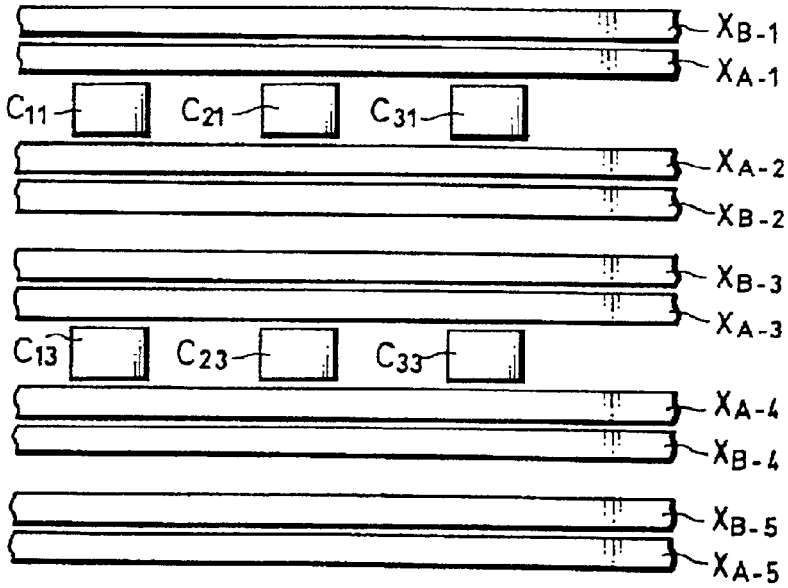
FIG. 5 is a plan view of a process of manufacturing method of an example of flat type plasma a discharge display device according to the present invention.

First, the manufacturing process of the first substrate 1 is described. As shown in FIG. 5, a first substrate 1 of, for example, glass substrate is prepared, and first and second discharge sustaining electrodes $X_A$ ($X_{A-1}$, $X_{A-2}$, $X_{A-3}$ . . . ) and $X_B$ ($X_{B-1}$, $X_{B-2}$, $X_{B-3}$ . . . ) of the discharge sustaining electrode group, and the discharge start address electrodes C ($C_{11}$, $C_{13}$, $C_{15}$ . . . , $C_{21}$, $C_{23}$, $C_{25}$ . . . , $C_{31}$, $C_{33}$, $C_{35}$ . . . ) are formed on its one major surface.

These electrodes can be formed by, for example, a lift-off method by using a photo resist layer. That is, although not shown, a photo resist layer is coated on the entire area of the substrate 1, the photo resist layer is subjected to a pattern exposure and development process, and openings are formed by removing the photo resist layers in the finally forming portions of respective electrode elements $X_A$ ($X_{A-1}$, $X_{A-2}$, $X_{A-3}$ . . . ), $X_B$ ($X_{B-1}$, $X_{B-2}$, $X_{B-3}$ . . . ), and C ($C_{11}$, $C_{13}$, $C_{15}$ . . . , $C_{21}$, $C_{23}$, $C_{25}$ . . . , $C_{31}$, $C_{33}$, $C_{35}$ . . . ), then a conductive layer is formed on the entire area of the first substrate 1, for example, by the vapor deposition.

This conductive layer may be composed of, for example, ITO (indium tin oxide) of transparent conductive layer, a metal layer of one or more metals such as Al, Cu, Ni, Fe, Cr, Zn, Au, Ag, Pb or the like, a laminate structure of Cr/Al of Al layer and surface layer of Cr layer or the like for preventing oxidization of Al thereon, or a conductive layer of multilayer structure of Cr/Al/Cr further including a base layer, for example, a base layer of Cr layer excellent in adhesion to the glass substrate.

By removing the photo resist layer, consequently, the conductive layer formed on the photo resist is removed, that is, lifted off, and the electrodes $X_A$ ($X_{A-1}$, $X_{A-2}$, $X_{A-3}$ . . . ), $X_B$ ($X_{B-1}$, $X_{B-2}$, $X_{B-3}$ . . . ), and C ($C_{11}$, $C_{13}$, $C_{15}$ . . . , $C_{21}$, $C_{23}$, $C_{25}$ . . . , $C_{31}$, $C_{33}$, $C_{35}$ . . . ) are formed by the remaining conductive layer.

Figure 6:
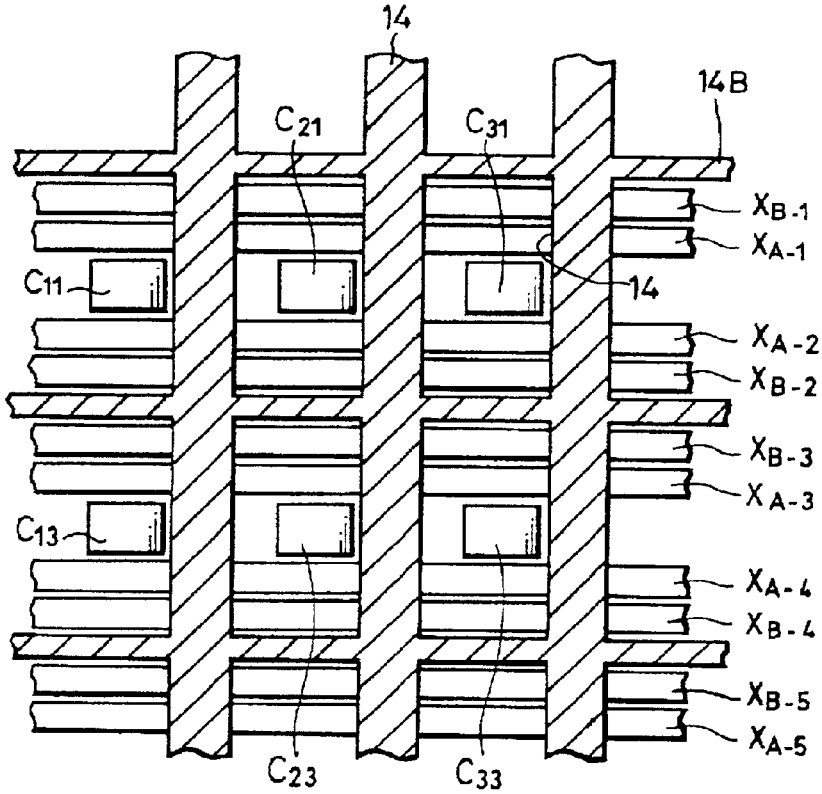
FIG. 6 is a plan view of a process of manufacturing method of an example of flat type plasma a discharge display device according to the present invention.

Next, as shown in FIG. 6, the insulating layer 14 is formed. This insulating layer 14 is formed in a lattice pattern including the forming part of the address electrode Y in a band form extending, for example, in the vertical direction as mentioned above, between the adjacent set of discharge sustaining electrodes without intervening the discharge start address electrode C (that is, between $X_{B-2}$ and $X_{B-3}$, $X_{B-4}$ and $X_{B-5}$ . . . ), and an opening 14*w* straddling over each plasma discharge part P composed by each discharge start address electrode C and the first mutually confronting discharge sustaining electrodes $X_A$ on both sides thereof to sandwich the same.

That is, in this example, the insulating layer portion interposed between the first and second discharge sustaining electrodes $X_A$ and $X_B$ and the address electrode Y, and the partition insulating layer 14B are formed integrally.

To form this insulating layer 14, on the entire surface of the first substrate 1, for example, a photosensitive glass paste is coated for composing an insulating layer, and heated for 20 minutes at 80° C., and this glass layer is exposed in pattern and developed, and is formed into the lattice pattern as mentioned above. It is then formed by baking at 600° C.

Then, as shown in FIG. 3, the address electrodes Y and connection pieces 15 extending onto the corresponding discharge start address electrodes C and connecting them electrically are formed. In this forming, too, they can be formed by the lift-off method. That is, in this case, too, a photo resist layer is coated on the whole area of the first substrate 1, the photo resist is patterned by pattern exposure and development, and then a conductive layer of, for example, Al is formed on the whole surface by the vapor deposition or the like. Then, by peeling off the photo resist layer, the address electrodes Y and the extended connection pieces 15 mentioned above are formed at the same time.

In this way, the respective electrodes are formed on the first substrate.

The terminals $T_X$ and $T_Y$ corresponding to the respective electrodes can be formed simultaneously with the corresponding discharge sustaining electrodes $X_A$ ($X_{A-1}$, $X_{A-2}$, $X_{A-3}$ . . . ) and $X_B$ ($X_{B-1}$, $X_{B-2}$, $X_{B-3}$ . . . ), and address electrodes Y ($Y_1$, $Y_2$, $Y_3$ . . . ), by extending the same from one end of the electrode each.

Then, as shown in FIG. 2, the dielectric layer 16 of $SiO_2$ or the like is formed on the entire surface excluding the extension parts of these terminals, that is, the outer peripheral parts of the substrate by the CVD (chemical vapor deposition) method, and further thereon, the surface layer 17 of MgO or the like as shown in FIG. 2 is formed by the vapor deposition or other method.

The manufacturing method of the second substrate 2 is described below. In this case, too, the second substrate 2 of, for example, glass substrate is prepared. On its one major or principal surface, the partition wall 18 as shown in FIG. 2 is formed. This partition wall 18 is formed by adhering a glass sheet for laminate, for example, Green Sheet (a trademark of Du Pont) to the entire inner surface of the substrate 2, and prebaking at 210° C. or 410° C.

By coating then a photo resist layer, and by pattern exposure and developing, the photo resist layer is removed by leaving the portion for forming the partition wall 18, that is, in the pattern of the partition wall 18.

Using this photo resist layer as a mask, by powder beam working or so-called sand blasting process, the glass sheet is removed while leaving the forming portion of the photo resist layer.

Then, removing the photo resist layer, it is sintered at 600° C., for example Thus, the partition wall 18 is formed of glass.

On the inner surface of the second substrate 2 thus forming the partition wall 18 in stripes, red, green and blue fluorescent materials R, G, B are formed sequentially, for example, in every two recess portions between the respective partition walls 18, and baked, for example, at 430° C., and the fluorescent layer 19 is formed.

After thus finishing the manufacturing process for the first and second substrates 1 and 2, the first and second substrates 1 and 2 are set so as to oppose the address electrodes Y ($Y_1$, $Y_2$, $Y_3$ . . . ) of the first substrate 1 and the partition walls 18 of the second substrate 2, and their peripheral parts are fritted with glass and sealed by heat treatment at, for example, 430° C.

In this case, the fritting position is selected at the inside position of the external leading-out parts and the terminals $T_X$ and $T_Y$ of the respective electrode elements.

In this case, setting of the position of the partition walls 18 and the address electrodes Y ($Y_1$, $Y_2$, $Y_3$ . . . ) does not require any particularly high precision.

The flat space thus formed between the first and second substrates 1 and 2 is heated, for example, at 380° C., and exhausted for 2 hours in this state, and this flat space is packed with the gas at a specified gas pressure. Thus, the flat type plasma a discharge display device according to the present invention is composed.

Figure 7:
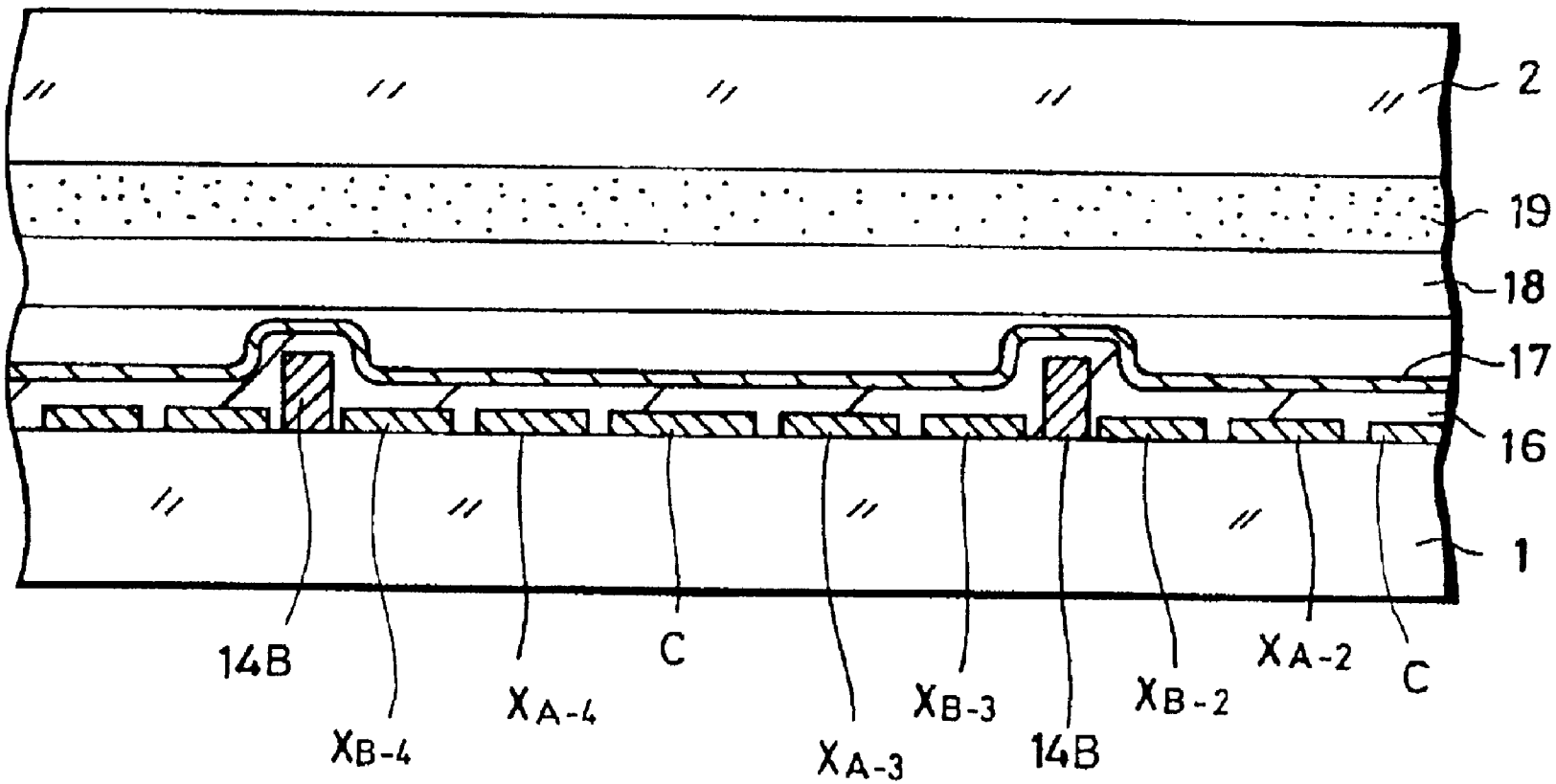
FIG. 7 is an essential longitudinal sectional view of the first substrate side of an example of flat type plasma a discharge display device according to the present invention.

FIG. 7 shows a longitudinal sectional view of its essential parts.

By the way, when such high temperature heat treatment is done after forming the electrode group of lower layer, in this example, the discharge sustaining electrode group X and the discharge start address electrode C, if the conductive layer formed before this high temperature treatment is composed, for example, of Al, it may be accompanied by various problems of deterioration of characteristics such as oxidation of Al and so on. In such a case, as mentioned above, it is preferred to form this conductive layer as a multilayer structure by forming a defective conductor layer of Cr on Al stable by oxidation for protecting it.

In this method, the respective electrodes are formed by the lift-off method, but not limited to this method, various methods may be applied, for example, a method of forming a conductive layer on the entire surface, and forming this conductive layer by pattern etching by the photolithography or the like.

As mentioned above, the interval between the first discharge sustaining electrodes $X_A$ ($X_{A-1}$, $X_{A-2}$, $X_{A-3}$ . . . ) and the confronting discharge start address electrodes C, or the interval between the first and second discharge sustaining electrodes $X_A$ ($X_{A-1}$, $X_{A-2}$, $X_{A-3}$ . . . ) and $X_B$ ($X_{B-1}$, $X_{B-2}$, $X_{B-3}$ . . . ) is set at specific interval respectively, but, as mentioned above, by forming these electrodes in the same process by the same conductive layer, the respective intervals can be set precisely. However, they may be also formed of conductive layers by different processes.

The partition walls 18 are selected at a height thereof capable of preventing mutual leak of discharge by dividing the unit discharge regions.

The sealing gas pressure P into the flat space between the first and second substrates 1 and 2 may be set at atmospheric pressure of 0.05 to 5.0 as mentioned above.

This sealing gas pressure P is selected according to Paschen's law, that is, when the discharge start voltage $V_S$ is selected at a specified voltage, for example, Paschen's minimum value, it is selected so that its product with the distance d between discharge electrodes, that is, the distance between each discharge start address electrode C confronting to the plane for forming the plasma discharge part P and the first discharge sustaining electrode $X_A$ (hereinafter called the distance between discharge electrodes), namely P·d may be constant.

When selecting the discharge start voltage $V_S$, for example, at the Paschen's minimum value, the distance d between discharge electrodes may be allowed within a fluctuation of ±10s % to the distance d determined at this time. When the discharge start voltage Vs is selected other than Paschen's minimum value, actually, there is an allowance of about ±30% to the electrode distance d determined at this time.

The distance d between the discharge sustaining electrodes can be selected at a tiny gap of less than 50 μm, 30 μm or less, preferably 20 μm or less, 5 μm or less, or 1 μm or less.

Figure 8A:
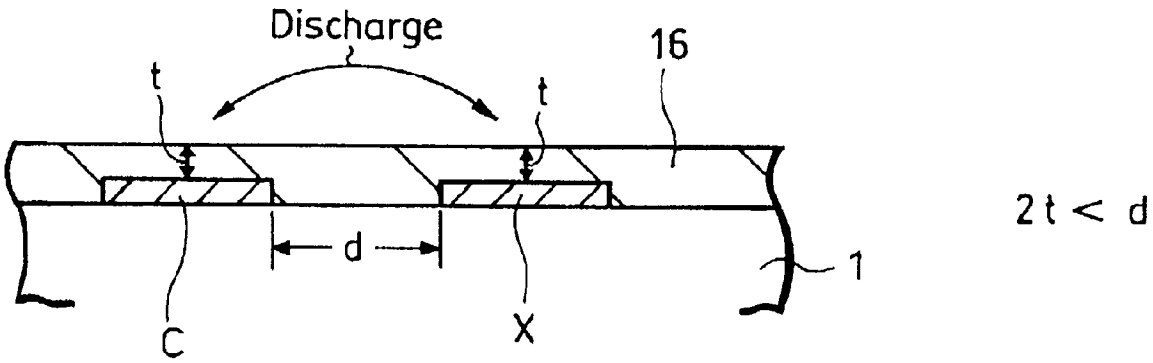
FIG. 8 consisting of FIGS. 8A through 8B is an explanatory diagram of selection of the distance between discharge electrodes.
Figure 8B:
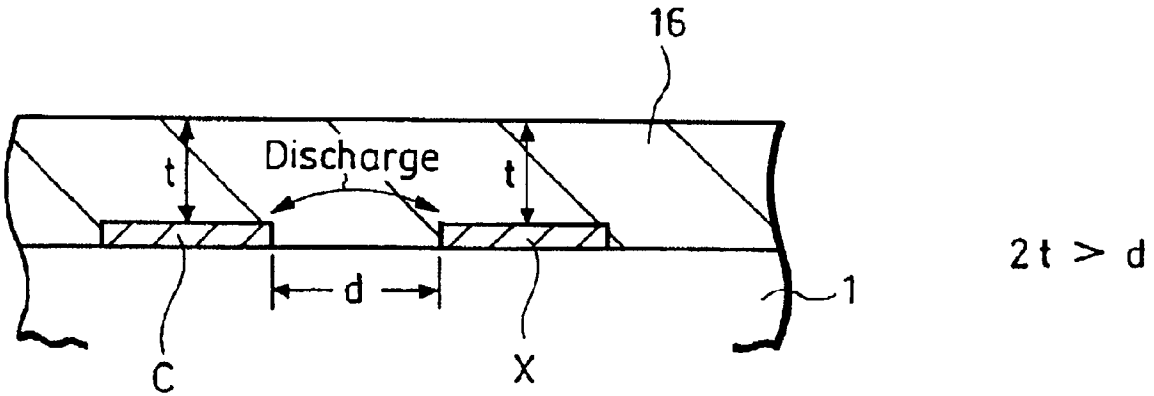

On the other hand, this distance d between the discharge electrodes must be also selected in relation with the thickness t of the dielectric layer 16. That is, as the discharge mode thereof is shown in FIG. 8A, in order to perform plasma discharge above the dielectric layer 16, it is required to discharge by penetrating through the dielectric layer 16 in the thickness direction, and as shown in FIG. 8B, it is required to avoid discharge between the first discharge sustaining electrode $X_A$ and the address electrode C in the dielectric layer 16, and for this purpose, supposing that the dielectric constant of the surface layer 17 is sufficiently lower than that of the dielectric layer 16, it is desired to select in the relation of 2t<d.

The driving method of the display device in this constitution is described below.

Figure 9:
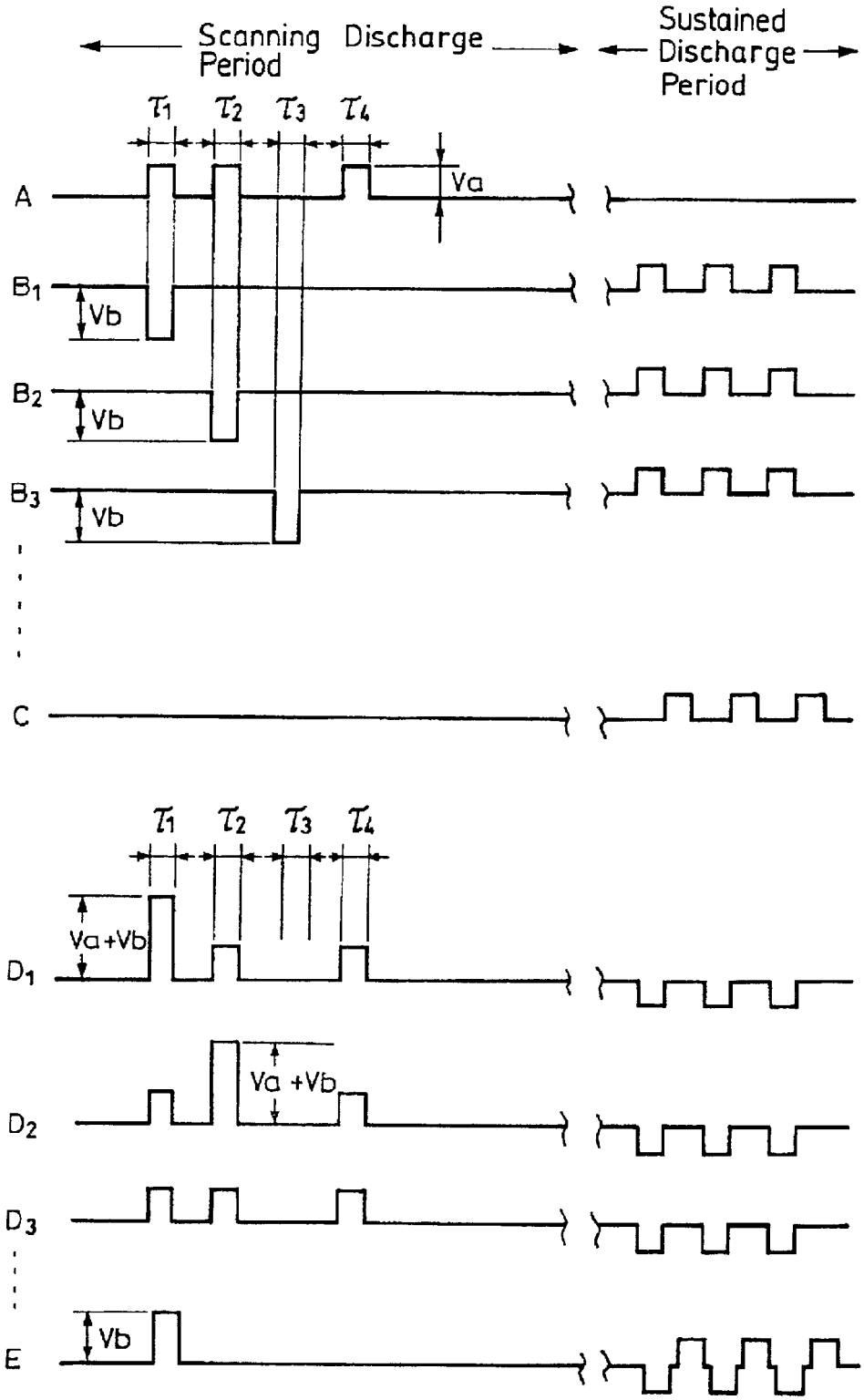
FIG. 9 is a driving waveform diagram of an example of driving method according to the present invention.

One example thereof explained by referring to the voltage waveform diagram in FIG. 9.

In this example, there is shown the driving waveform for performing the display about one address electrode Y1.

FIG. 9A shows the display signal waveform to be applied to this one address electrode $Y_1$, and in this case, for example, there is shown an operation of discharging, or turning on the pixels positioned at the intersections of the first, second and fourth horizontal scanning lines, and, herein, a specified ON voltage Va is supplied at intervals or sections $\tau_1$, $\tau_2$, $\tau_4$.

On the other hand, to the first discharge sustaining electrodes $X_{A-1}$, $X_{A-2}$, $X_{A-3}$ . . . corresponding to the horizontal scanning lines, a specified ON voltage Vb of reverse polarity to the voltage Va is changed over and applied sequentially in sections $\tau_1$, $\tau_2$, $\tau_3$ . . . , as shown in FIG. 9$B_1$, $B_2$, $B_3$ . . . . At this time, no voltage is applied to the second discharge sustaining electrodes $X_B$ ($X_{B-1}$, $X_{B-2}$, $X_{B-3}$ . . . ) as shown in FIG. 9C.

In the next sustaining discharge period, consequently, in each horizontal scanning line, pulse voltages shown in FIGS. 9$B_1$, $B_2$, $B_3$ . . . , and C are applied to each pair of first and second discharge sustaining electrodes $X_A$ ($X_{A-1}$, $X_{A-2}$, $X_{A-3}$ . . . ) and $X_B$ ($X_{B-1}$, $X_{B-2}$, $X_{B-3}$ . . . ).

When such driving waveform is applied to each electrode, as shown in FIG. 9$D_1$, $D_2$, $D_3$ . . . , in the scanning discharge period, a voltage of Va+Vb is applied in section $\tau_1$ between the first discharge sustaining electrode $X_{A-1}$ and the discharge start address electrode $C_{11}$ in the first horizontal scanning line, that is, in the plasma discharge part $P_{11}$, in section $\tau_2$ between the first discharge sustaining electrode $X_{A-2}$ and the discharge start address electrode $C_{11}$ in the second horizontal scanning line, that is, in the plasma discharge part $P_{21}$, and in section $\tau_4$ between the first discharge sustaining electrode $X_{A-4}$ and the discharge start address electrode $C_{12}$ in the fourth horizontal scanning line, that is, in the plasma discharge part $P_{41}$.

At this time, by selecting Va+Vb preliminarily higher than the discharge start voltage and selecting the individual voltages Va and Vb at a voltage not reaching the discharge start voltage alone, ON (discharge) is started only in the pixels in the plasma discharge parts $P_{11}$, $P_{21}$, $P_{41}$ in the selected first, second and fourth horizontal scanning lines.

Thus, as to the pixels once turned on in this way, in the subsequent sustaining discharge period, a specified AC voltage shown in FIG. 9E is applied sequentially between each scanning electrode and the discharge sustaining electrode, so that their discharge state continues.

Thus, the discharge or light emission on the whole screen, that is, all pixels can be controlled by the display signal, and the target or intended image can be displayed.

Or, by once turning on all pixels prior to the scanning period, target pixels may be erased depending on the display image in the scanning period, and the image may be displayed.

As described herein, in the constitution according to the present invention, by applying a changeover voltage to each one of the first discharge sustaining electrodes $X_A$ ($X_{A-1}$, $X_{A-2}$, $X_{A-3}$ . . . ), and applying an image signal to the address electrode Y ($Y_1$, $Y_2$, $Y_3$ . . . ), the same display operation as in the plasma discharge display device of ordinary matrix type can be realized.

Also in the flat type plasma discharge display device in the constitution according to the present invention, in particular, when applying the interlacing method, the signal processing circuit for this interlacing can be omitted, so that the driving circuit may be simplified.

Figure 10:
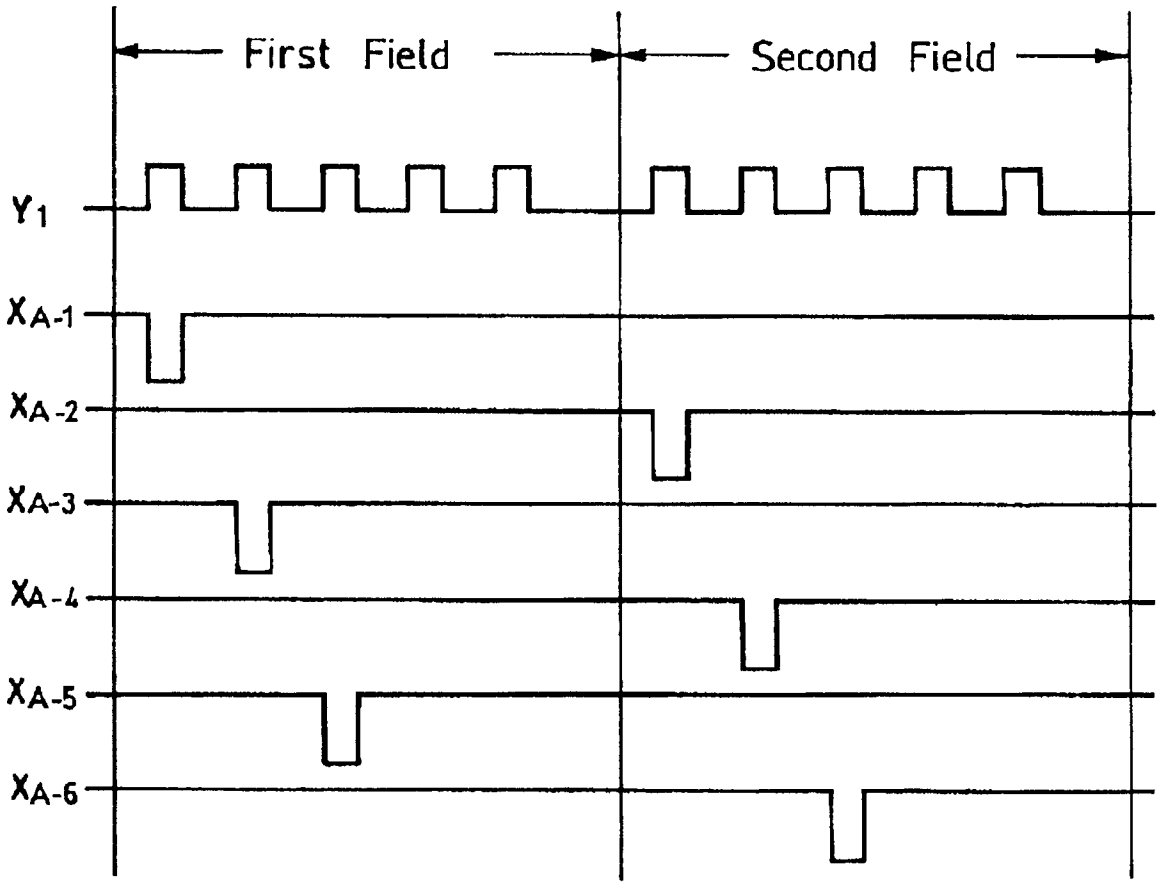
FIG. 10 is a driving waveform diagram of other example of driving method according to the invention.

That is, in the flat type plasma a discharge display device in the constitution according to the present invention, for one discharge start address electrode C, there are formed pairs of plasma discharge parts $P_{11}$, and $P_{21}$, $P_{12}$ and $P_{22}$, $P_{13}$ and $P_{23}$ . . . , and therefore, in the interlace driving, in the first field, each one of the plasma discharge parts $P_{11}$, $P_{12}$, $P_{13}$ . . . , $P_{31}$, $P_{32}$, $P_{33}$ . . . can be operated, and in the second field, other plasma discharge parts $P_{21}$, $P_{22}$, $P_{23}$ . . . , $P_{41}$, $P_{42}$, $P_{43}$ . . . can be operated. That is, as the driving waveform is shown in FIG. 10 (which shows only the electrode element $Y_1$ as for the image signal), in the first field period, the specified voltage Vb mentioned above is applied sequentially to the first discharge sustaining electrodes $X_{A-1}$, $X_{A-3}$, $X_{A-5}$ . . . relating to each one of the plasma discharge parts $P_{11}$, $P_{12}$, $P_3$ . . . , $P_{31}$, $P_{32}$, $P_{33}$ . . . , and in the second field period, the specified voltage Vb is applied sequentially to the other one of the first discharge sustaining electrodes $X_{A-1}$, $X_{A-4}$, $X_{A-6}$ . . . , thereby making it possible to perform the interlace display.

Thus, according to the device according to the present invention, the interlace display can be carried out without using any particular signal processing circuit.

That is, in the general television (TV) broadcast at the present, video signals of interlace broadcast are sent out. Therefore, most TV receivers conform to the interlace standard, and package media are also conforming the same. By contrast, in the display for a personal computer, plasma display panel or the like, it is based on the sequential scanning such as progressive or non-interlace process, and for carrying out the interlace image display, once video signals of one frame (two fields) are taken and stored in the signal processing circuit, and then the signals are sequentially taken out, and driven and displayed. Actually, by using a semiconductor memory or other element, video signals are held and are sequentially converted and scanned.

Specifically, when displaying NTSC signals on a 480-line screen, the operation is as follows. The transmission side sends out two screens in one frame (30 Hz). One screen has information of jumping 240 lines. Therefore, the display, after receiving two screens, sequentially scans 480 lines. In the display extremely affected by flicker represented by a liquid crystal, in the case of writing of 30 Hz of scanning 480 lines once in one frame, flicker or the like occurs, and this phenomenon is avoided by issuing the same image twice, or rewriting the image information of every 240 lines at every field. However, according to the writing twice, the resolution of image is lowered, and the image becomes dull. Anyway, so as to display the interlaced signal image by such device, the signal processing circuit is required to have a memory function.

According to the device according to the present invention and the interlace driving method according to the present invention, such memory function is not necessary, and hence the circuit constitution for display is simplified.

According to each driving method mentioned above, when each pair of plasma discharge parts P ($P_{11}$, $P_{12}$, $P_{13}$ . . . , $P_{21}$, $P_{22}$, $P_{23}$ . . . , $P_{31}$, $P_{32}$, $P_{33}$ . . . ) are discharged independently, that is, when they are composed as individual pixels, the light emitting luminance can be doubled by turning on each pair simultaneously, that is, plasma discharge parts $P_{11}$ and $P_{21}$, $P_{12}$ and $P_{22}$, $P_{13}$ and $P_{23}$ . . . . In this case, by applying the above-mentioned voltage Vb simultaneously, for example, between the first discharge sustaining electrodes $X_{A-1}$ and $X_{A-2}$, $X_{A-3}$ and $X_{A-4}$ . . . , the same information is displayed in the pair of plasma discharge parts P. Therefore, according to this driving method, display of higher luminance is realized.

As shown in the above example, by narrowing the interval between the pair of discharge sustaining electrodes for discharge sustaining, and by performing the discharge mainly by the cathode glow discharge, the luminance can be enhanced while the driving power is far smaller than in the negative glow discharge, and, for example, as compared with the case of negative glow discharge, the brightness is increased by more than 40 percent.

Moreover, as the interval between the discharge sustaining electrodes is narrower, two plasma discharge parts P may be formed in one discharge start part, and therefore in case of interlace display or simultaneous light emission, a sufficiently high precision is obtained.

In the example of this embodiment, as shown in FIG. 4, for example, in the extended direction of the address electrodes Y, or vertical direction (y-direction), two pairs of discharge sustaining electrodes, or four discharge sustaining electrodes are disposed between the adjacent discharge start address electrodes C, but instead of two pairs of discharge sustaining electrodes, using one electrode of the pair of electrodes as a common electrode, three discharge sustaining electrodes may be also disposed between the adjacent discharge start address electrodes C.

In such constitution, the interval between the discharge start address electrodes C in the vertical direction can be narrowed, so that many advantage can be presented such as the density of the light emitting area can be heightened, the aperture rate contributing to light emission can be enhanced, and the number of electrode terminals can be decreased, and so on.

Figure 11:
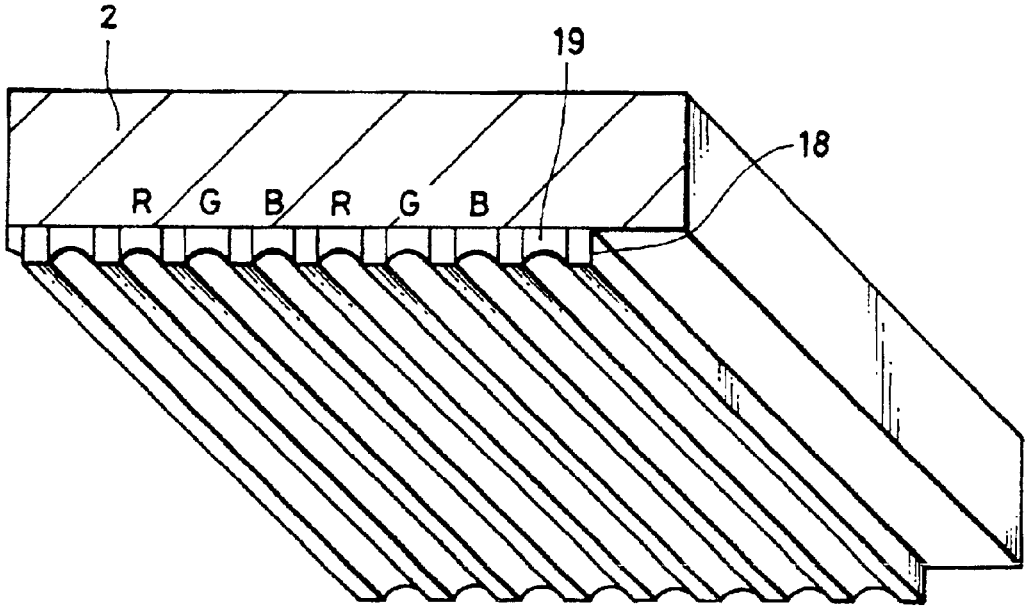
FIG. 11 is a partially cut-away essential perspective open view of other example of flat type plasma a discharge display device according to the present invention.
Figure 11:
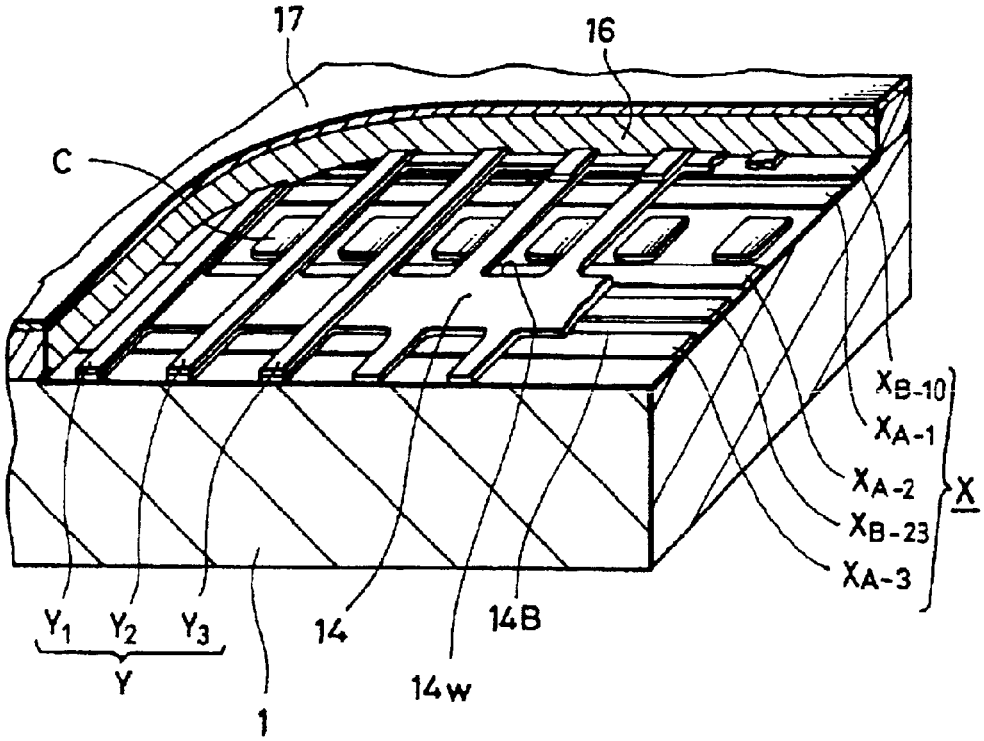
Figure 12:
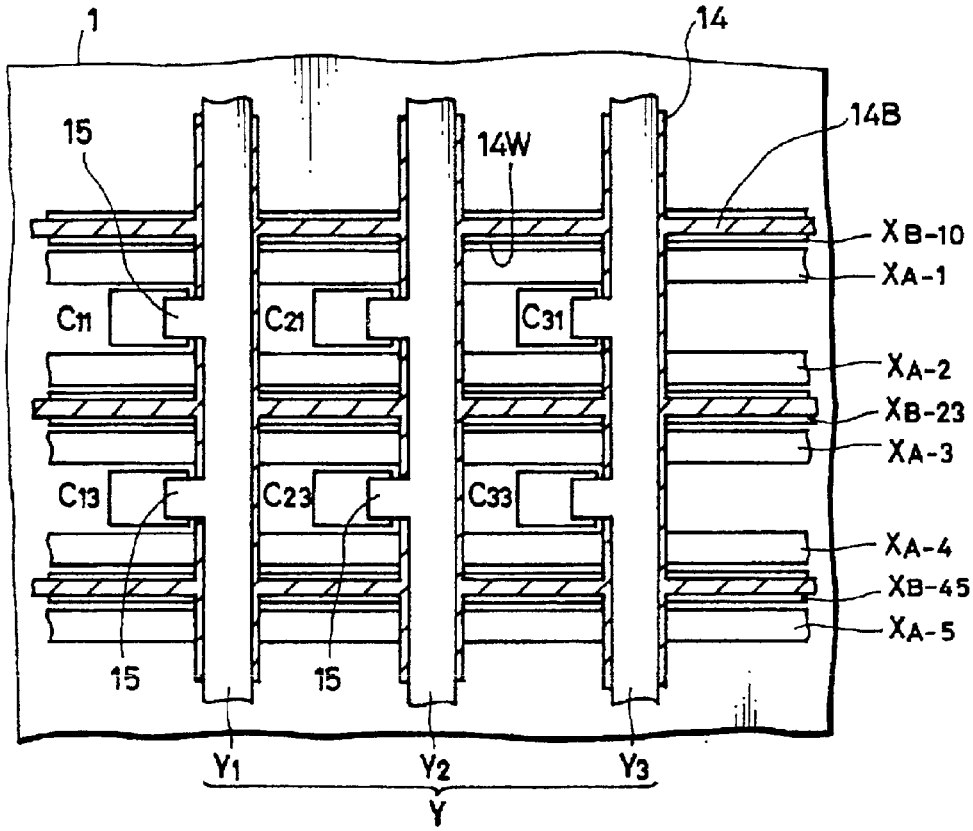
FIG. 12 is a plan view showing a state of forming electrodes on a common substrate of the flat type plasma a discharge display device according to the present invention.
Figure 13:
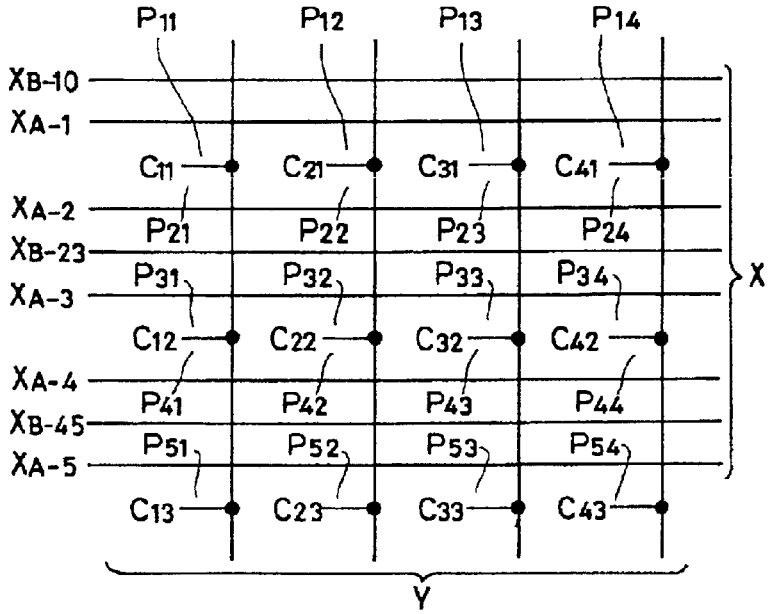
FIG. 13 is a schematic electrode layout diagram showing an electrode layout example of the flat type plasma a discharge display device according to the present invention.

FIG. 11 is a partially cut-away perspective exploded view of essential parts of an example of the flat type plasma discharge display device according to the present invention in which one of the two pairs of adjacent discharge sustaining electrodes is used as a common electrode, FIG. 12 is a plan view of its essential parts, and FIG. 13 is a schematic diagram of its electrode layout or configuration.

In FIG. 11 to FIG. 13, the parts corresponding to FIG. 2 to FIG. 4 are identified with same reference numerals and duplicate explanation will be omitted.

In this example, between the discharge start address electrodes C adjacent with each other in the vertical direction, three discharge sustaining electrodes are disposed. In this constitution, too, on both sides of each discharge start address electrode C, discharge sustaining electrodes $X_A$ ($X_{A-1}$, $X_{A-2}$, $X_{A-3}$ . . . ) are disposed opposite to each electrode C to thereby form pairs of plasma discharge parts $P_{11}$, and $P_{21}$, $P_{31}$ and $P_{41}$ . . . , $P_{12}$ and $P_{22}$ . . . . In this case, however, one discharge sustaining electrode $X_B$, that is, $X_{B-23}$, $X_{B-45}$ . . . is commonly disposed between adjacent two discharge sustaining electrodes $X_A$, that is, $X_{A-2}$ and $X_{A-3}$, $X_{A-4}$ and $X_{A-5}$ . . . , thereby composing the discharge parts P respectively.

The constitution of respective parts, the manufacturing method and the driving method of the flat type plasma a discharge display device with this constitution may be also same as the constitution of respective parts, the manufacturing method and the driving method of the example of the foregoing embodiment.

Explaining the driving method in this case, likewise, to the first discharge sustaining electrodes $X_{A-1}$, $X_{A-2}$, $X_{A-3}$ . . . corresponding to the horizontal scanning lines, a specified ON voltage Vb of reverse polarity to the voltage Va is changed over and applied sequentially in sections $\tau_1$, $\tau_2$, $\tau_3$, $\tau_4$ . . . , as shown in FIG. 9$B_1$, $B_2$, $B_3$ . . . . At this time, no voltage is applied to the second discharge sustaining electrodes $X_B$ ($X_{B-10}$, $X_{B-23}$, $X_{B-45}$ . . . ) as shown in FIG. 9C.

In the next sustained discharge period, consequently, in each horizontal scanning line, the pulse voltages shown in FIGS. 9$B_1$, $B_2$, $B_3$ . . . , and C are applied to each pair of first and second discharge sustaining electrodes $X_A$ ($X_1$, $X_{A-2}$, $X_{A-3}$ . . . ) and $X_B$ ($X_{B-10}$, $X_{B-23}$, $X_{B-45}$ . . . ).

When such driving waveform is applied to each electrode, as shown in FIG. 9$D_1$, $D_2$, $D_3$ . . . , in the scanning discharge period, a voltage of Va+Vb is applied selectively in section $\tau_1$ between the first discharge sustaining electrode $X_{A-1}$ and the discharge start address electrode $C_{11}$ in the first horizontal scanning line, that is, in the plasma discharge part $P_{11}$, and in section $\tau_4$ between the first discharge sustaining electrode $X_{A-2}$ and the same discharge start address electrode $C_{11}$ in the second horizontal scanning line, that is, in the plasma discharge part $P_{41}$, between the plasma discharge sustaining electrode $X_{A-4}$ and discharge start address electrode $C_{12}$.

In this time, too, by selecting Va+Vb preliminarily equal to or higher than the discharge start voltage and selecting the individual voltages Va and Vb at a voltage not reaching the discharge start voltage alone, ON (discharge) is started only in the pixels in the plasma discharge parts $P_{11}$, $P_{21}$, $P_{41}$ in the selected the first, second and fourth horizontal scanning lines.

Thus, as to the pixels once turned on, in the subsequent sustained discharge period, if the specified AC voltage shown in FIG. 9E is applied sequentially between each scanning electrode and the discharge sustaining electrode, their discharge state is continued.

Thus, the discharge or light emission on the whole screen, that is, all pixels can be controlled by the display signal, and the intended image can be displayed.

In this case, also by once turning on all the pixels prior to the scanning period, the target pixels may be erased depending on the display image in the scanning period, and the image may be displayed.

As described herein, in this constitution, too, by applying a changeover voltage to each one of the first discharge sustaining electrodes $X_A$ ($X_{A-1}$, $X_{A-2}$, $X_{A-3}$ . . . ), and applying an image signal to each address electrode Y ($Y_1$, $Y_2$, $Y_3$ . . . ), the same display operation as in the plasma discharge display device of ordinary matrix type can be realized.

Also in this example, in particular, when applying the interlacing method, the signal processing circuit for this interlacing can be omitted, so that the driving circuit may be simplified.

That is, for one discharge start address electrode C, pairs of plasma discharge parts, that is, $P_{11}$, and $P_{21}$, $P_{12}$ and $P_{22}$, $P_{13}$ and $P_{23}$ . . . are composed, and therefore, in interlace driving, in the first field, each one of the plasma discharge parts $P_{11}$, $P_{12}$, $P_{13}$ . . . , $P_{31}$, $P_{32}$, $P_{33}$ . . . is operated, while in the second field, other plasma discharge parts $P_{21}$, $P_{22}$, $P_{23}$ . . . , $P_{41}$, $P_{42}$, $P_{43}$ . . . are operated. That is, as the driving waveform therefor is shown in FIG. 10 (which shows only the electrode element $Y_1$ as for the image signal), in the first field period, the specified voltage Vb is applied sequentially to the first discharge sustaining electrodes $X_{A-1}$, $X_{A-3}$, $X_{A-5}$ . . . relating to each one of the plasma discharge parts $P_{11}$, $P_{12}$, $P_{13}$ . . . , $P_{31}$, $P_{32}$, $P_{33}$ . . . , and in the second field period, the specified voltage Vb is applied sequentially to the other one of the first discharge sustaining electrodes $X_{A-2}$, $X_{A-4}$ . . . , thereby making it possible to perform the interlace display.

Also in this case, too, the emission luminance may be doubled by simultaneously turning on each pair of plasma discharge parts $P_{11}$, and $P_{21}$, $P_{12}$ and $P_{22}$, $P_{13}$ and $P_{23}$ . . . . That is, in this case, by applying the voltage Vb simultaneously, for example, to the first discharge sustaining electrodes $X_{A-1}$ and $X_{A-2}$, $X_{A-3}$ and $X_{A-4}$ . . . , the same information is displayed in the pair of plasma discharge parts P. Therefore, according to this driving method, display of high luminance is realized.

Also in this example of flat type plasma discharge display device in the constitution shown in FIG. 11 to FIG. 13, the same effects as in the device according to the present invention explained in FIG. 1 to FIG. 4 are obtained, and moreover as compared with the flat type plasma discharge display device in the constitution shown in FIG. 1 to FIG. 13, since the number of discharge sustaining electrodes can be decreased, a higher definition and a higher density may be realized.

In the embodiment mentioned above, the discharge sustaining electrode group and the address electrode group are disposed on the common substrate, but the discharge sustaining electrode group and the address electrode group may be also disposed on mutually different substrates. An embodiment of flat type plasma discharge display device of the invention according to such constitution and its driving method (as second embodiment) will be explained now.

[Second Embodiment]

In the flat type plasma discharge display device, too, a first substrate and a second substrate are disposed face to face while keeping a specified interval therebetween to thereby compose a flat type display container. In this flat type plasma discharge display device, the discharge sustaining electrode group arranging a plurality of discharge sustaining electrodes is formed at the first substrate side, and the address electrode group arranging a plurality of address electrodes is formed at the second substrate side.

For one discharge start part by the address electrode, a plurality of plasma discharge parts are formed, and an interval Ds between the pair of discharge sustaining electrodes in discharge sustaining about these plasma discharge parts is set equal to or less than 50 $\mu$m, preferably 20 $\mu$m or less, for example, 10 $\mu$m or less, and basically, plasma discharge is sustained not depending on the negative glow discharge mainly by the cathode glow discharge, that is, by the discharge mainly dominated by the cathode glow discharge.

The interval between the address electrode and the corresponding discharge sustaining electrode is selected, for example, at 100 $\mu$m or more, or 130 $\mu$m, and start of discharge by the negative glow discharge, that is, the discharge start state can be formed.

According to the second embodiment, since the discharge sustaining is mainly done by the cathode glow discharge, its driving power is extremely small as compared with the negative glow discharge, and the luminance is enhanced also.

By the way, in the case when the discharge is performed by cathode glow discharge, as compared with the negative glow discharge, if the driving power is the same, the brightness thereof is increased by more than 40 percents.

Moreover, since the interval between the first and second discharge sustaining electrodes is narrowed by this mode of cathode glow discharge, the density of each plasma luminous part is enhanced, and higher definition and higher density are realized.

Figure 14:
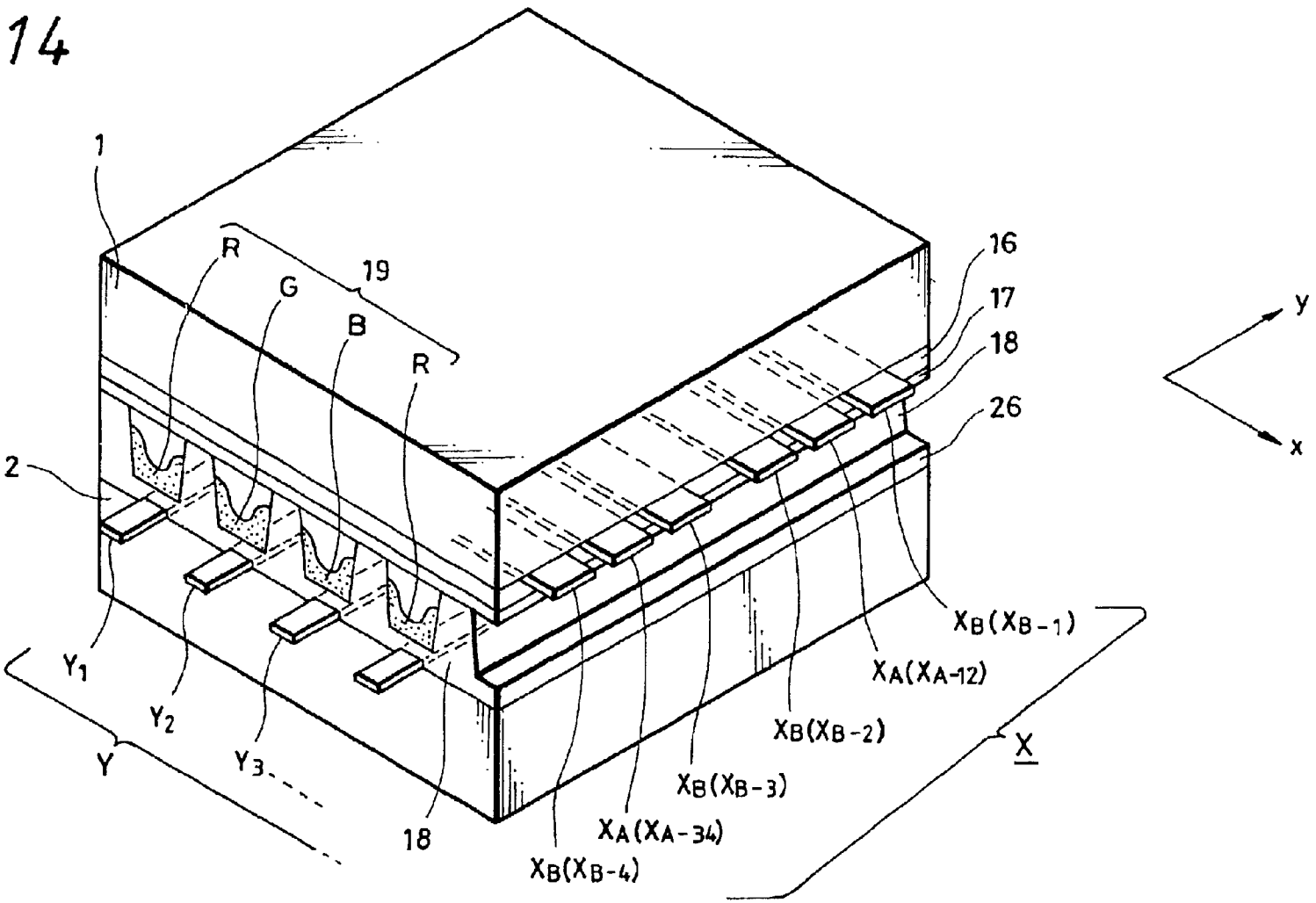
FIG. 14 is a partial perspective view of an example of flat type plasma a discharge display device according to the present invention.

FIG. 14 is a partial perspective view of an example of the flat type plasma a discharge display device of the second embodiment.

That is, in this flat type plasma discharge display device, too, first and second substrates 1 and 2 each made of, for example, a glass substrate are placed face to face while keeping a specified interval therebetween and, although not shown, their peripheral parts are sealed air-tightly by, for example, flitting and sealing, whereby a flat space is formed between the both substrates 1 and 2, thereby composing a flat container.

In this example, too, the luminous display is observed from the first substrate 1 side, and in this case, at least the first substrate 1 is formed of a transparent glass substrate for transmitting the display light therethrough.

On the inner surface of the first substrate 1, there is formed a discharge sustaining electrode group X which is formed of a plurality of first and second discharge sustaining electrodes $X_A$ and $X_B$ in stripes, extending mainly in a direction along the substrate surface (x-direction), and arranged parallel to each other, being made of transparent electrodes or good conductive, for example opaque metal electrodes in a specified arrangement as described later.

The first and second discharge sustaining electrodes $X_A$ and $X_B$ of the discharge sustaining electrode group X are made of, for example, transparent conductive layer of ITO, single-layer metal conductive layers of conductive and display light impermeable material or having enough thickness, such as Al, Ag, Cr, Cu, Ni or the like, two-layer film structures of, for example, Al/Cr by combination of such metal layers, or three-layer film structures of Cr/Al/Cr and so on.

On the discharge sustaining electrode group X, a dielectric layer 16 of $SiO_2$ or the like same as in the example mentioned above is formed, and further thereon, a surface layer 17 of MgO or the like is formed same as in the case above.

On the inner surface of the second substrate 2, there is formed an address electrode group Y which is formed of a plurality of address electrodes $Y_1$, $Y_2$, $Y_3$ . . . in stripes, extending in a direction intersecting with the x-direction, for example, an orthogonal direction (y-direction), along the substrate surface, and arranged parallel to each other, being made of conductive and display light impermeable material or opaque metal electrodes having thickness.

Each address electrode of the address electrode group Y is made of, for example, a single-layer metal conductive layer excellent in conductivity, such as Al, Ag, Cr, Cu, Ni or the like, a two-layer film structure of, for example, Al/Cr by combination of such metal layers, or a three-layer film structures of Cr/Al/Cr and so on.

On the address electrode layer Y, a dielectric layer (insulating layer) 26 of, for example, $SiO_2$ is formed. Thereon, further, a partition wall 18 in stripes extending in the y-direction is formed at position between the address electrodes Y ($Y_1$, $Y_2$, $Y_3$ . . . ). Between the partition walls 18, same as in the first embodiment, fluorescent materials R, G, B emitting red, green and blue lights by excitation of ultraviolet rays (vacuum ultraviolet rays) generated by plasma discharge are coated in specified sequence.

The partition wall 18 has a function as a spacer for holding the space between the first and second substrates 1 and 2 with a specified thickness, and a function of defining the discharge space relating to the x-direction.

Figure 15:
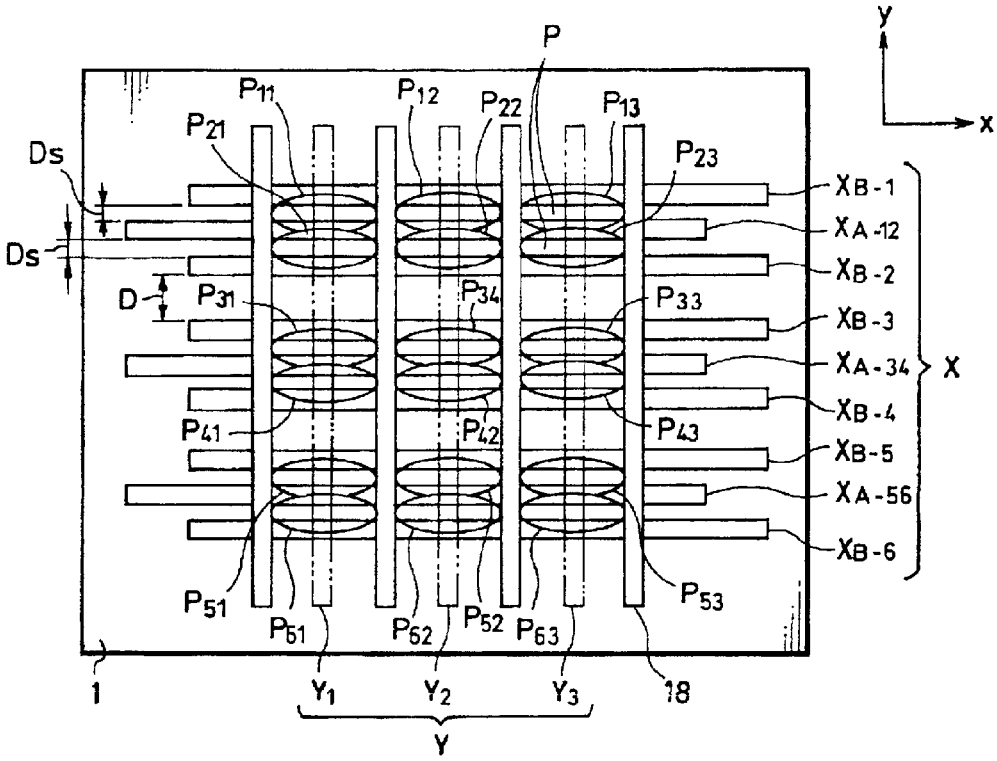
FIG. 15 is a plan view showing an electrode layout example of flat type plasma a discharge display device according to the present invention.

FIG. 15 is a schematic plan view showing an example of the layout relation between the discharge sustaining electrode group X and the address electrode group Y.

In this example, the discharge sustaining electrode group X is such one that for each one of the first discharge sustaining electrode $X_A$ at its both sides each one of the second discharge sustaining electrode $X_B$ is disposed.

That is, at both sides of the first discharge sustaining electrodes $X_A$ ($X_{A-12}$, $X_{A-34}$, $X_{A-56}$ . . . ), the second discharge sustaining electrodes $X_B$ ($X_{B-1}$ and $X_{B-2}$, $X_{B-3}$ and $X_{B-4}$, $X_{B-5}$ and $X_{B-6}$ . . . ) are disposed to sandwith the same.

In this case, the interval between each one of the first discharge sustaining electrodes $X_A$ ($X_{A-1}$, $X_{A-34}$, $X_{A-56}$ . . . ) and the second discharge sustaining electrodes $X_B$ ($X_{B-1}$ and $X_{B-2}$, $X_{B-3}$ and $X_{B-4}$, $X_{B-5}$ and $X_{B-6}$ . . . ), that is, the interval between counter electrodes forming a pair in discharge sustaining is selected at the above-mentioned interval $D_s$, that is, equal to or less than 50 $\mu$m of the distance for generating mainly the cathode glow discharge, preferably 20 $\mu$m or less, for example, 10 $\mu$m. In this case, since any one of the discharge path between the counter electrodes is not the shortest path, even if the negative glow discharge occur simultaneously with the cathode glow discharge, the cathode glow discharge is always dominant.

On the other hand, the interval D between the adjacent second discharge sustaining electrodes $X_B$ is defined in the relation of D>Ds.

The interval between the address electrode Y ($Y_1$, $Y_2$, $Y_3$ . . . ) and the first discharge sustaining electrode $X_A$ is selected, for example, at 100 $\mu$m or more, for example, 130 $\mu$m, so that substantially the discharge is started by the negative glow discharge, that is, the discharge start state is formed.

Evacuating the air-tight space formed by the first and second substrates 1 and 2, it is packed with a specified discharge gas, for example, one or more types of rare gas such as He, Ne, Ar, Xe, Kr, or a so-called Penning gas mixing Ne and Xe optimally, Ne (96%) and Xe (4%), at atmospheric pressure of 0.05 to 5, for example. This gas sealing pressure is selected at a pressure capable of sustaining the discharge stably at high luminance and high efficiency, in relation to the interval between the address electrodes Y ($Y_1$, $Y_2$, $Y_3$ . . . ) and the first and second discharge sustaining electrodes $X_A$ and $X_B$.

Thus, discharge start parts are formed corresponding to the intersections of the address electrode Y ($Y_1$, $Y_2$, $Y_3$ . . . ) and the first discharge sustaining electrode $X_A$ ($X_{A-12}$, $X_{A-34}$, $X_{A-56}$ . . . ), and corresponding to each discharge start part, two plasma discharge parts P ($P_{11}$, and $P_{21}$, $P_{31}$ and $P_{41}$ . . . , $P_{12}$ and $P_{22}$, $P_{32}$ and $P_{42}$ . . . ) are formed.

An example of the embodiment of the driving method of the display device in this embodiment will be described below, but in this case, too, basically it can be driven by the same method as mentioned in the first embodiment. Herein, too, it is explained by referring to the voltage waveform in FIG. 9.

In this example, with each one of the first discharge sustaining electrodes $X_A$ ($X_{A-12}$, $X_{A-34}$, $X_{A-56}$ . . . ) used common, two horizontal scanning lines are formed by two each of the second discharge sustaining electrodes Y ($Y_1$ and $Y_2$, $Y_3$ and $Y_4$, $Y_5$ and $Y_6$, . . . ) disposed at both sides thereof.

This is to show the driving waveform for displaying about one address electrode $Y_1$.

FIG. 9A shows a display signal waveform to be applied to this one address electrode $Y_1$, and this case shows an example of discharging or turning on about the pixels positioned at the intersections of the first, second and fourth horizontal scanning lines, and a specified ON voltage Va is supplied at sections $\tau_1$, $\tau_2$, $\tau_4$ in this case.

On the other hand, to the first discharge sustaining electrodes $X_A$ ($X_{A-12}$, $X_{A-34}$, $X_{A-56}$ . . . ) corresponding to each horizontal scanning line, a specified ON voltage Vb of reverse polarity to the voltage Va is changed over and applied sequentially in sections $\tau_1$, $\tau_2$, $\tau_3$, $\tau_4$ . . . , as shown in FIG. 9 $B_1$, $B_2$, $B_3$ . . . . At this time, no voltage is applied to the second discharge sustaining electrodes $X_B$ ($X_{B-1}$, $X_{B-2}$, $X_{B-3}$ . . . ) as shown in FIG. 9C.

In the next sustained discharge period, in each horizontal scanning line, the pulse voltage shown in FIGS. 9$B_1$, $B_2$, $B_3$ . . . , and C is applied to each pair of first and second discharge sustaining electrodes $X_A$ ($X_{A-12}$, $X_{A-34}$, $X_{A-56}$ . . . ) and $X_B$ ($X_{B-1}$, $X_{B-2}$, $X_{B-3}$ . . . ).

When such driving waveform is applied to each electrode, as shown in FIG. 9$D_1$, $D_2$, $D_3$ . . . , in the scanning discharge period, the voltage of Va+Vb is selectively applied between the first discharge sustaining electrode $X_{A-12}$ and the address electrode $Y_1$ in the first horizontal scanning line, that is, on the plasma discharge part $P_{11}$, in section $\tau_1$, and between the first discharge sustaining electrode $X_{A-12}$ and the similar address electrode $Y_1$ in the second horizontal scanning line, that is, on the plasma discharge part P21 in section $\tau_2$, and further between the first discharge sustaining electrode $X_{A-34}$ and the address electrode $Y_1$ in the fourth horizontal scanning line, that is, on the plasma discharge part $P_{41}$ in section $\tau_4$.

At this time, by preliminarily setting this Va+Vb equal to or higher than the discharge start voltage given above, and by selecting the voltage Va or Vb which individually may not reach the discharge start voltage, ON (discharge) is started only on the pixels at the plasma discharge parts $P_{11}$, $P_{21}$, $P_{41}$ on the selected first, second and fourth horizontal scanning lines.

As to the pixels once turned on mentioned above, in the subsequent sustained discharge period, the discharge state is sustained as the specified AC voltage shown in FIG. 9E is sequentially applied between each scanning electrode and the discharge sustaining electrode. This discharge state is sustained mainly by the cathode glow discharge because, as mentioned above, the interval between the first and second discharge sustaining electrodes $X_A$ and $X_B$ is selected at a narrow gap of equal to or less than 50 $\mu$m, preferably 20 $\mu$m or less.

By the above-mentioned driving method, the discharge or light emission on the entire screen, that is, entire pixels can be controlled by display signal, and the intended video can be displayed.

By the way, by once turning on all the pixels prior to the scanning period, the video display may be formed by erasing the intended pixels depending on the display image in the scanning period.

As described herein, in the constitution according to the present invention, by applying the changeover voltage to the first discharge sustaining electrodes $X_A$ ($X_{A-12}$, $X_{A-34}$, $X_{A-56}$ . . . ) and applying the image signal to the address electrodes Y ($Y_1$, $Y_2$, $Y_3$ . . . ), the same display operation as in the plasma discharge display device of ordinary matrix type can be realized.

Also in this flat type plasma a discharge display device, the interlace driving method can be applied thereto. That is, in this case, for example, in the first field, by the first discharge sustaining electrode $X_A$ ($X_{A-12}$, $X_{A-34}$, $X_{A-56}$ . . . ) and the second discharge sustaining electrode Y ($Y_1$, $Y_3$, $Y_5$ . . . ) adjacent to one of the same, that is, relating to the first, third, fifth . . . horizontal scanning lines, the discharge emission is effected, and in the second field, similarly, by the first discharge sustaining electrode $X_A$ ($X_{A-12}$, $X_{A-34}$, $X_{A-56}$ . . . ) and the second discharge sustaining electrode Y ($Y_2$, $Y_4$, $Y_6$ . . . ) adjacent to the other of the same, that is, relating to the second, fourth, sixth . . . horizontal scanning lines, the discharge emission is effected.

That is, in the flat type plasma a discharge display device in the constitution according to the present invention, since for one discharge start address electrode C there are composed of pairs of plasma discharge parts $P_{11}$ and $P_{21}$, $P_{12}$ and $P_{22}$, $P_{13}$ and $P_{23}$ . . . , in the interlace driving, one plasma discharge parts $P_{11}$, $P_{12}$, $P_{13}$ . . . , $P_{31}$, $P_{32}$, $P_{33}$ . . . are operated in the first field, and the other plasma discharge parts $P_{21}$, $P_{22}$, $P_{23}$ . . . , $P_{41}$, $P_{42}$, $P_{43}$, . . . are operated in the second field.

Thus, according to the device according to the present invention, the interlace display is realized without using any particular signal processing circuit.

In this driving method, moreover, each pair of plasma discharge parts P ($P_{11}$, $P_{12}$, $P_{13}$ . . . , $P_{21}$, $P_{22}$, $P_{23}$ . . . , $P_{31}$, $P_{32}$, $P_{33}$ . . . ) are discharge independently, that is, they are composed as individual pixels, but the luminous intensity can be doubled by simultaneously turning on each pair, that is, plasma discharge parts $P_{11}$ and $P_{21}$, $P_{12}$ and $P_{22}$, $P_{13}$ and $P_{23}$ . . . . In this case, concerning the second discharge sustaining electrodes $X_B$ ($X_{B-1}$ and $X_{B-2}$, $X_{B-3}$ and $X_{B-4}$ . . . ), by applying the discharge sustaining voltage simultaneously, the same information is displayed in each pair of plasma discharge parts P. In this case, too, a high luminance display is made for one pixel, substantially.

Figure 16:
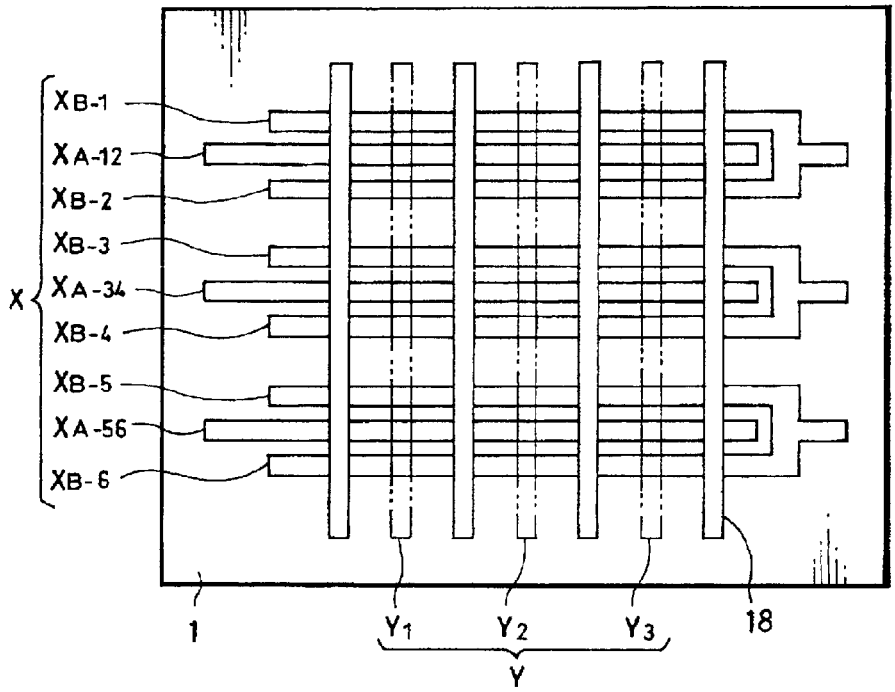
FIG. 16 is a plan view showing other electrode layout example of flat type plasma a discharge display device according to the present invention.

Thus, in the case of performing the simultaneously luminous display of pairs of plasma discharge parts $P_{11}$, and $P_{21}$, $P_{12}$ and $P_{22}$, $P_{13}$ and $P_{23}$ . . . , as shown in FIG. 16, the second discharge sustaining electrodes $X_B$ ($X_{B-1}$, and $X_{B-2}$, $X_{B-3}$ and $X_{B-4}$, $X_{B-5}$, and $X_{B-6}$ . . . ) to sandwich the same disposed on both sides of the first discharge sustaining electrodes $X_A$ ($X_{A-12}$, $X_{A-34}$, $X_{A-56}$ . . . ) to sandwich the same may be formed as mutually linked patterns.

In FIG. 16, the parts corresponding to FIG. 15 are identified with the same reference numerals and duplicate explanation thereof will be omitted.

Figure 17:
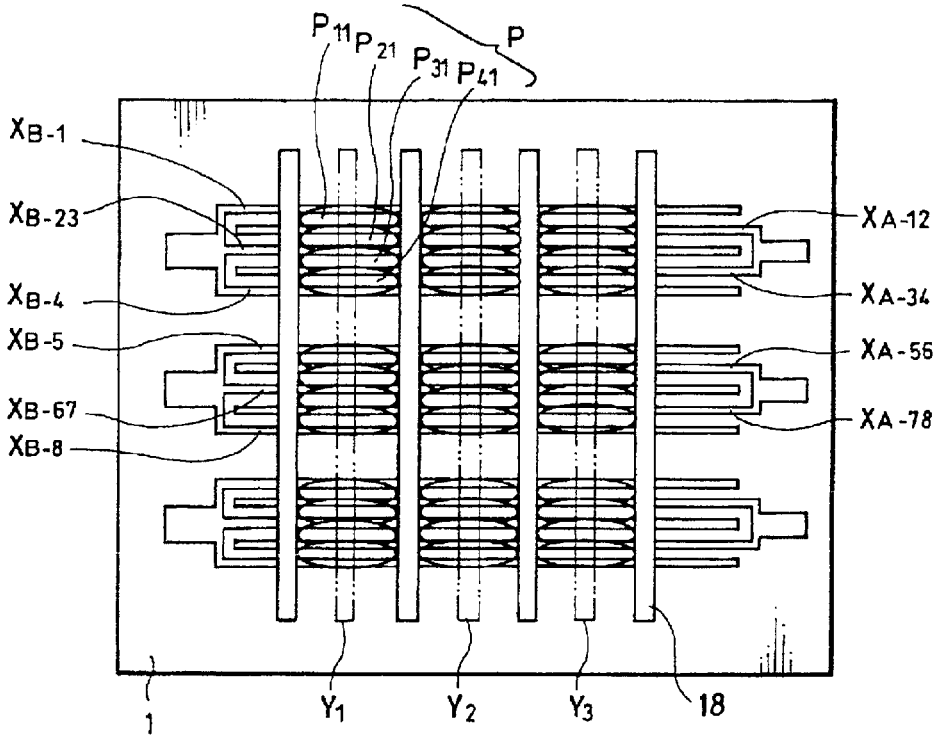
FIG. 17 is a plan view showing other electrode layout example of flat type plasma a discharge display device according to the present invention.

In the examples shown in FIG. 15 and FIG. 16, at both sides of each one of the first discharge sustaining electrodes $X_A$ ($X_{A-12}$, $X_{A-34}$, $X_{A-56}$ . . . ), pairs of second discharge sustaining electrodes $X_B$ ($X_{B-1}$ and $X_{B-2}$, $X_{B-3}$ and $X_{B-4}$ . . . ) are disposed so as to sandwich the same, or as shown in FIG. 17, assembling a plurality of, for example, two each of the first discharge sustaining electrodes $X_A$ ($X_{A-12}$ and $X_{A-34}$, $X_{A-56}$ and $X_{A-78}$ . . . ) as one set, the second the second discharge sustaining electrodes $X_B$ ($X_{B-1}$ and $X_{B-23}$, and $X_{B-4}$, $X_{B-5}$ and $X_{B-67}$ and $X_{B8}$ . . . ) may be disposed at both sides of the set of the first discharge sustaining electrodes $X_A$, and four plasma discharge parts each $P_{11}$, and $P_{21}$ and $P_{31}$ and $P_{41}$, $P_{12}$ and $P_{22}$ and $P_{32}$ and $P_{42}$ . . . may disposed for each discharge start part.

The layout pattern of the first and second discharge sustaining electrodes is not limited to the illustrated examples alone, but various layout patterns may be possible, and a plurality of plasma discharge parts P can be formed.

The first and second discharge sustaining electrodes $X_A$ and $X_B$ may be, as stated above, composed of transparent electrodes, or non-transparent metal electrodes. Alternatively, only one discharge sustaining electrode, for example, only the first discharge sustaining electrode $X_A$ may be made of a non-transparent metal electrode, and the second discharge sustaining electrode $X_B$ may be made of a transparent electrode.

Figure 18:
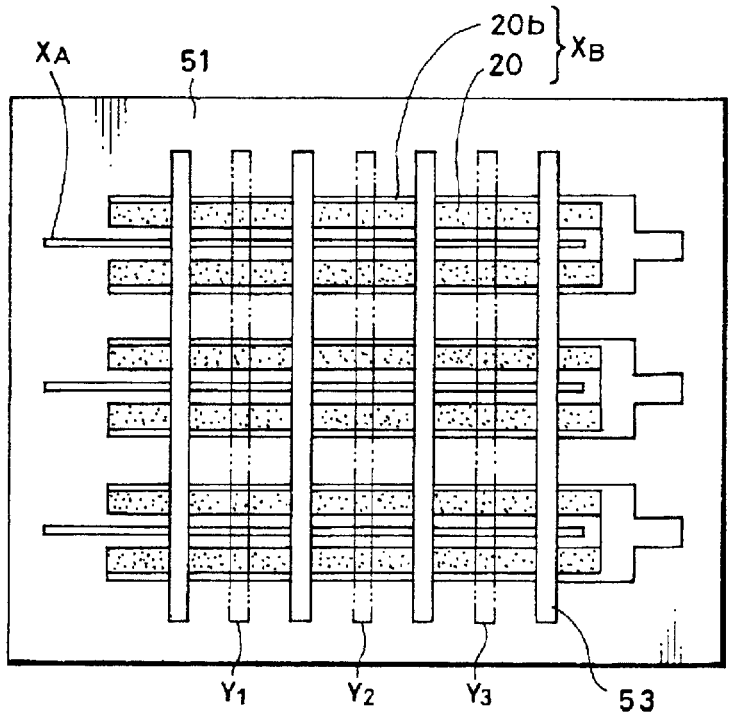
FIG. 18 is a plan view showing other electrode layout example of flat type plasma a discharge display device according to the present invention.

For example, as shown in FIG. 18, the second discharge sustaining electrode $X_B$ is formed of a transparent electrode 20, and a non-transparent and highly conductive metal bus electrode 20*b* is, for example, laminated and formed along its one side edge.

Figure 19:
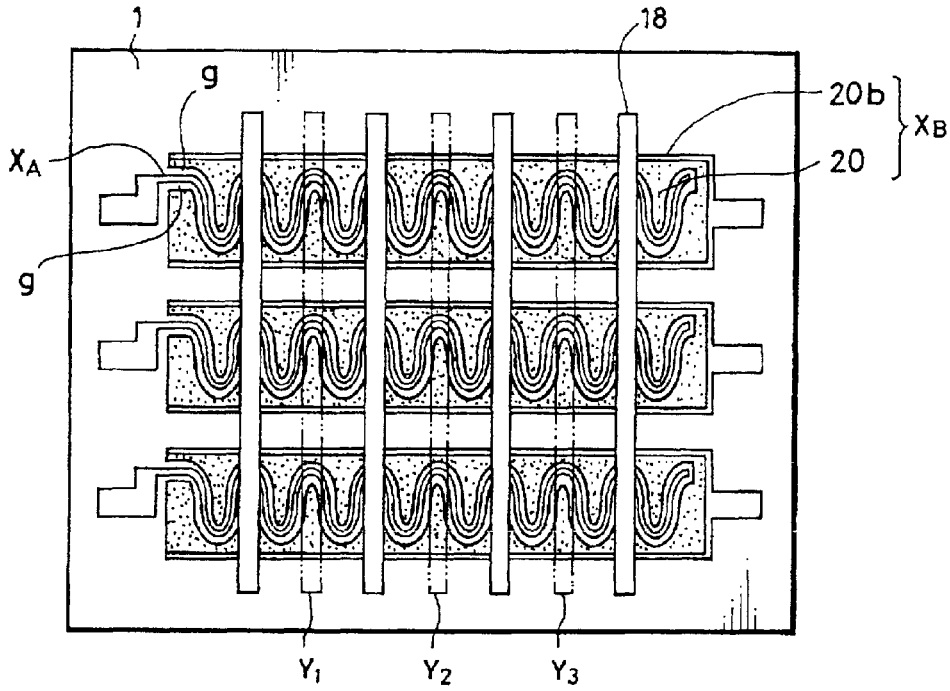
FIG. 19 is a plan view showing other electrode layout example of flat type plasma a discharge display device according to the present invention.
Figure 20:
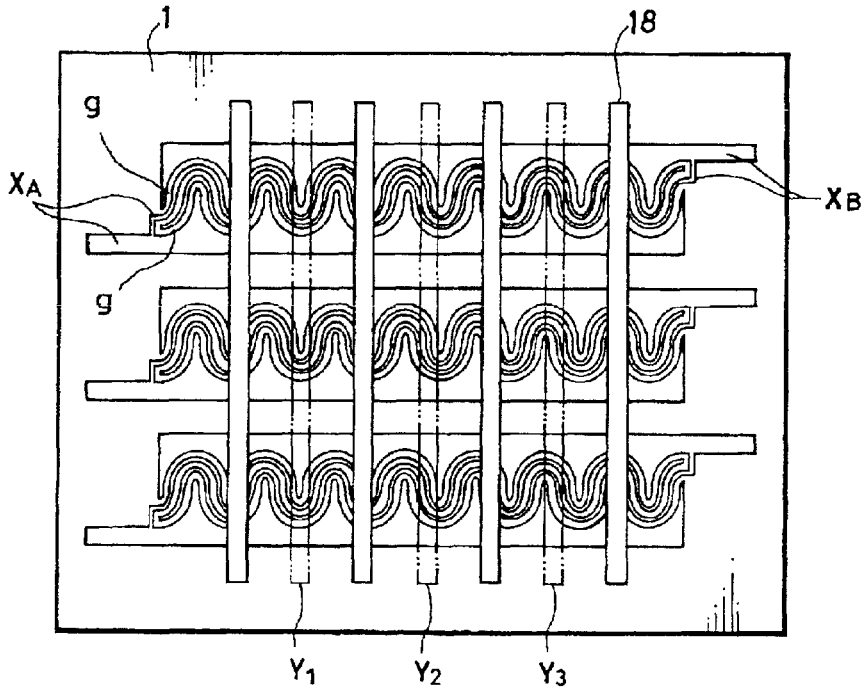
FIG. 20 is a plan view showing other electrode layout example of flat type plasma a discharge display device according to the present invention.

Or, the first and second discharge sustaining electrodes $X_A$ and $X_B$ may be formed as shown in FIG. 19 or FIG. 20, in which the principal extending direction thereof is selected in the x-direction mentioned above, but the confronting edges of mutual discharge sustaining, that is, the discharge gap g may be formed in a zigzag pattern curved or bent in the width direction of electrodes $X_A$ and $X_B$. When the shape of the discharge gap g is a bent or curved pattern in this way, the confronting edge length is long, so that the light emission amount of the vacuum ultraviolet rays can be increased, and hence the luminance may be further enhanced.

Thus, the discharge gap can be formed in a curved or bent pattern because, as mentioned above, by narrowing the interval between the first and second discharge sustaining electrodes $X_A$ and $X_B$, the width of the discharge sustaining electrodes $X_A$ and $X_B$ can be increased as compared with the case of the conventional negative glow discharge having the gap of 100 $\mu$m or more, for example, even 130 $\mu$m.

Moreover, since the width of the first and second discharge sustaining electrodes $X_A$ and $X_B$ is increased as set both above, the electric resistance of these electrodes can be reduced, and the disposition of the bus electrodes can be omitted by sufficiently increasing the width of one or both of the electrodes $X_A$ and $X_B$.

Still more, since the interval between the first and second discharge sustaining electrodes $X_A$ and $X_B$ is narrowed, if a plurality of light emissions are performed at the same time for one pixel, high definition and high density are maintained, while the luminance can be enhanced.

As shown in the example, for its discharge sustaining, mainly the cathode glow discharge may be composed, but by selecting the interval between the address electrode Y and the first discharge sustaining electrode $X_A$ for starting discharge therewith at a large interval of, for example, 150 $\mu$m in the case of negative glow discharge, a bright display is realized by sufficiently increasing the discharge space, the layout space of the fluorescent materials R, G and B, and the layout area of the fluorescent materials R, G and B.

An example of manufacturing method of the flat type display device of the second embodiment will be described below.

First, the manufacturing method of the first substrate 1 shown in FIG. 14 is described. For example, a first substrate 1 made of a transparent glass substrate is prepared, and the discharge sustaining electrodes $X_A$ and $X_B$ are formed on the inner surface of this substrate 1.

These discharge sustaining electrodes $X_A$ and $X_B$ are formed in such a manner that on the entire inner surface of the substrate 1, the ITO of the above transparent conductive layer or various metals for composing the discharge sustaining electrodes $X_A$ and $X_B$ is formed as a film by the thin film technology such as sputtering method or the like, and the film is subjected to the pattern etching by, for example, the photolithography or by the screen printing of conductive paste, whereby the desired pattern is formed therein.

To form the bus electrode 20*b*, a conductive metal to compose this bus electrode, for example, Ag, Al, Ni, Cu, Cr or the like, is formed on the entire area by the sputtering or the like, and is formed into a desired pattern by carrying out the pattern etching by the photolithography, or a conductive paste is screen printed, and formed into a desired pattern.

Then, on the entire area, a dielectric layer 16 of $SiO_2$ is formed by the CVD (Chemical Vapor Deposition) method or the like, and MgO small in work function and having transmissivity for the visible light is formed thereon in a thickness of about 0.5 to 1.0 $\mu$m by, for example, the electron beam vapor deposition method or the like, and a surface layer 17 is formed.

On the other hand, in the manufacturing method of the second substrate 2, for example, a second substrate 2 made of a glass substrate is prepared, and address electrodes Y ($Y_1$, $Y_2$, $Y_3$ . . . ) are formed thereon. To form the address electrodes, the conductive metal such as Au, Ag, Al, Ni, Cu, Cr or the like is formed by the sputtering or the like, and then is formed into a desired pattern by the pattern etching by the photolithography, or a conductive paste is screen printed, and a desired pattern is formed.

Then, as shown in FIG. 14, covering the address electrodes Y ($Y_1$, $Y_2$, $Y_3$ . . . ), a dielectric layer 26 made of, for example, $SiO_2$ or the like is similarly formed on the entire area by the CVD method or the like.

Between the respective address electrodes Y ($Y_1$, $Y_2$, $Y_3$ . . . ) on the dielectric layer 26, then a partition wall 18 is formed at a height of about 100 $\mu$m or more, for example, about 130 $\mu$m. The partition wall 18 is formed by repeating the printing and the drying of glass paste, for example, several times. Alternatively, by coating a glass paste on the entire area, a mask of photo resist layer is formed in a specified pattern by the photolithography, and the glass paste in the portions not covered with the mask is removed by sand blasting, so that the partition wall 18 of desired pattern is formed.

Afterwards, in the bottom of the groove between the side surfaces of the adjacent partition walls 18, fluorescent layers R, G, B of respective colors are coated by the screen printing or exposure printing by using photosensitive slurry, and formed along each groove in specified sequence, that is, along the extending direction of the partition wall 18.

Thereafter, the first and second substrates 1 and 2 are placed face to face in such a manner that the extending direction of each electrode of the discharge sustaining electrode X may intersect the extending direction of each electrode of the address electrode group Y and the partition wall 18 at the right angle, and the peripheral parts of the first and second substrates 1 and 2 are fritted and sealed, whereby a flat container is composed by the both substrates 1 and 2.

Thus, the first and second substrates 1 and 2 are defined with the interval by the height of the partition wall 18, and the interval between the two substrates 1 and 2, that is, the interval between the address electrode and the discharge sustaining electrode is defined.

The flat container formed by the first and second substrates 1 and 2 is exhausted, and packed with the discharge gas, for example, Penning gas at a specified pressure.

In this case, too, at least one side edge of each of the first and second substrates 1 and 2 is actually formed to project outside from the other substrate mutually, and the end portion of each electrode is extended to this projecting area outside of the airtight space, so that a current feeding terminal to each electrode is formed.

In the above-mentioned second embodiment, the interval between the address electrode and the discharge sustaining electrode for starting the discharge therewith is set at 100 $\mu$m or more, for example, 130 $\mu$m, and this discharge start is made by the negative glow discharge, but this discharge start may be mainly effected by the cathode glow discharge. Such an embodiment (third embodiment) in this case will be described below.

[Third Embodiment]

In this embodiment, too, the first and second substrates are placed face to face, and the peripheral parts are air-tightly sealed by fritting or the like, and a flat space is formed between the both substrates as a flat container.

On the first substrate, a discharge sustaining electrode group arranging a plurality of discharge sustaining electrodes is formed, while on the second substrate, an address electrode group arranging parallely a plurality of address electrodes is formed in addition to a plurality of partition walls formed parallel.

The discharge sustaining electrode group is composed of a plurality of discharge electrodes forming a pair when sustaining the discharge which are arranged parallel while keeping a specified interval mutually, with the principal extending direction in one direction (x-direction) along the substrate surface of the first substrate.

The partition walls are formed parallel long the second substrate surface, while keeping a specified gap mutually, extending in a direction intersecting with the x-direction, for example, in an orthogonal direction (y-direction), and the address electrode is formed at least on one side surface of each partition wall.

This address electrode may be formed to straddle over the bottom of grooves of the mutually confronting sides of adjacent partition walls.

The address electrode may be either deposited and formed on the side of each partition wall as mentioned above, or formed of a conductive layer extending in the extending direction of the partition wall within each partition wall, so that one side edge thereof may be positioned to face the side surface of the partition wall or near the side surface, and disposed at the position shifted to this side.

Thus, when forming the address electrode by the conductive layer in this manner, each partition wall is composed of, for example, a partition wall main body and a laminate insulating layer formed on its top, and between the partition wall main body and the laminate insulating layer, the above-mentioned conductive layer, that is, the address electrode is disposed.

The address electrodes can be disposed at both sides of each partition wall, and in this case, the address electrodes relating to both sides of each partition wall are formed so as to be mutually isolated electrically. Specifically, the address electrodes relating to the mutually confronting surface of the adjacent partition walls are electrically coupled at their ends. Alternatively, straddling over the address electrodes on the confronting surfaces, the address electrode is extended in the bottom of the groove between the partition walls, so that the above-mentioned address electrodes are mutually connected electrically.

From the mutually connected address electrodes, common terminals can be led out.

On the grooves between the mutually confronting surfaces of the adjacent partition walls, fluorescent materials for emitting the light by excitation by vacuum ultraviolet rays generated by plasma discharge mentioned later are coated.

For example, in a display device for performing a color display, fluorescent materials R, G, B for emitting red, green and blue lights are coated on the inside of every other groove in a specified sequence, and formed in a specified arrangement.

The interval between the address electrode for starting the discharge or exciting the discharge and the discharge sustaining electrode as the confronting discharge electrode making a pair with the address electrode is at less than 50 $\mu$m, preferably 20 $\mu$m or less, for example, 10 $\mu$m.

The interval between the pair of discharge sustaining electrodes when sustaining the discharge of the discharge sustaining electrode group is also selected at 50 $\mu$m or less, preferably 20 $\mu$m or less, for example, 10 $\mu$m.

Further, on the first substrate, crisscross protrusions are formed.

The crisscross protrusions are formed of protrusions extending along, for example, the y-direction opposite to each partition wall of the second substrate, and intersecting protrusions extending in the X-direction between a set of confronting electrodes for sustaining discharge of the discharge sustaining electrodes, intersecting with these protrusions.

Figure 21:
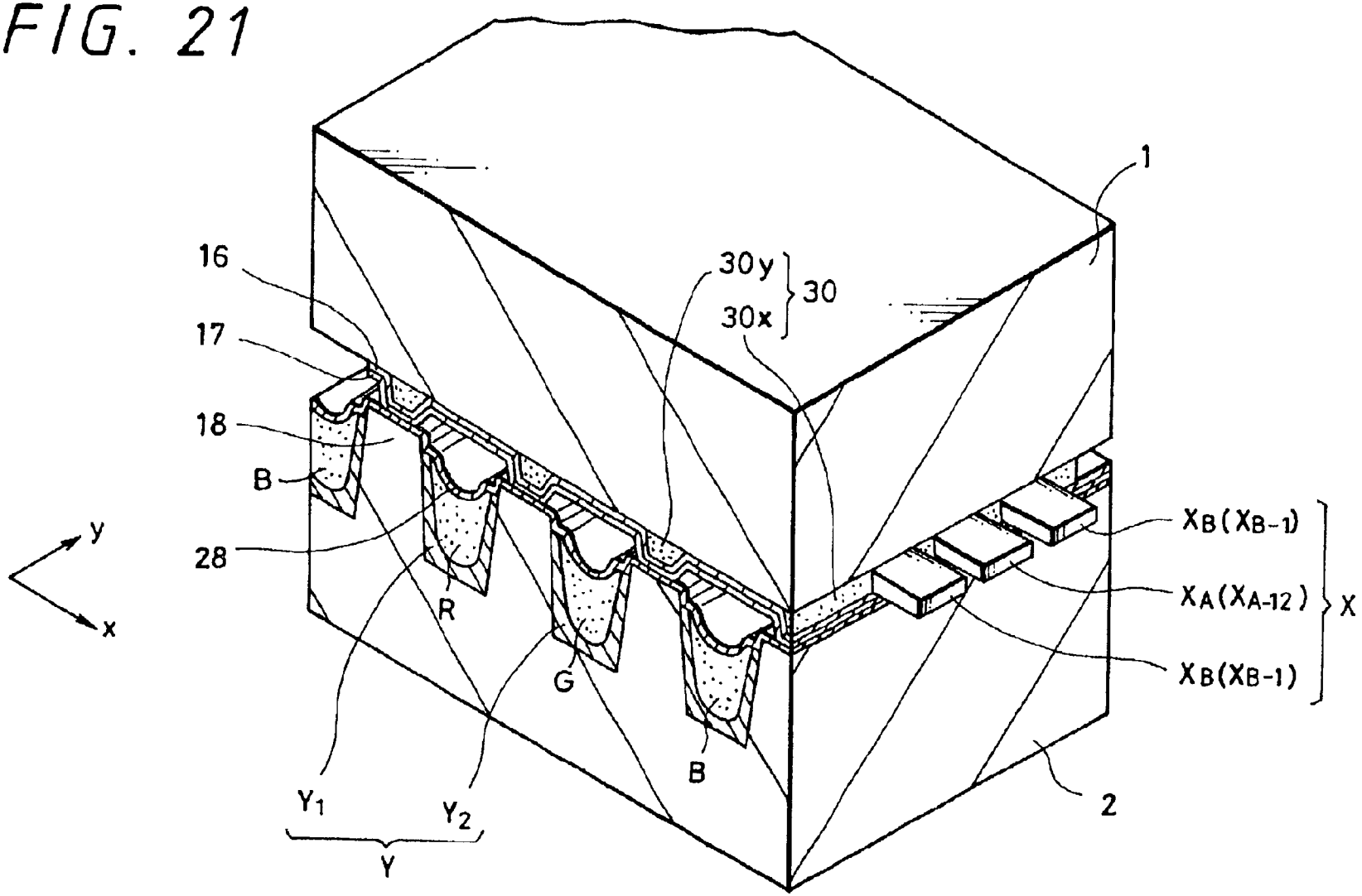
FIG. 21 is a partial perspective view of other example of flat type plasma a discharge display device according to the present invention.

An example of the third embodiment is described while referring to FIG. 21 showing a partially cut-away schematic perspective view thereof, but the embodiment is not limited to this example alone.

In this example, too, the first and second substrates 1 and 2 made of, for example, glass substrates are formed face to face, and although not shown, the peripheral parts of the both substrates 1 and 2 are sealed air-tightly by the fritting or the like.

Also in this embodiment, the first substrate 1 is used as the front side substrate, and the luminous display is observed from this first substrate 1 side. In this case, at least the first substrate 1 is made of a transparent glass substrate for transmitting therethrough the display light.

On the inner surface of the first substrate 1, there is formed a discharge sustaining electrode group X which is formed of a plurality of first and second discharge sustaining electrodes $X_A$ and $X_B$, for example, in stripes, extending mainly in a direction along the substrate surface (x-direction), made and arranged parallel to each other, being made of transparent electrodes or conductive and opaque metal electrodes in a specified arrangement as described later.

Each of the first and second discharge sustaining electrodes $X_A$ and $X_B$ of the discharge sustaining electrode group X is made of, for example, a transparent conductive layer of ITO, a single-layer metal conductive layer of conductive and display light impermeable material or having enough thickness, such as Al, Ag, Cr, Cu, Ni or the like, a two-layer film structure of, for example, Al/Cr by combination of such metal layers, or a three-layer film structure of Cr/Al/Cr.

Figure 22:
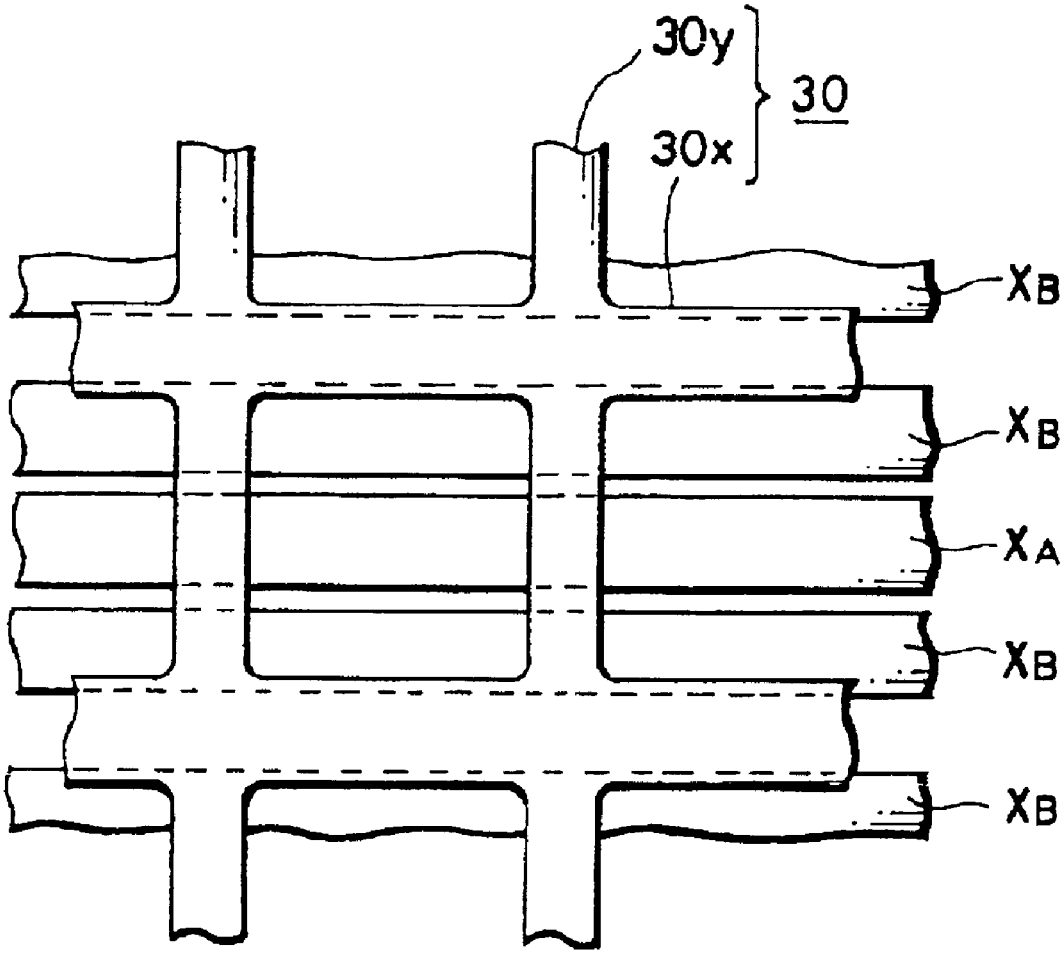
FIG. 22 is a plan view showing an example of layout relation between electrodes and protrusions of flat type plasma a discharge display device according to the present invention.

Also on the first substrate 1, as its essential parts are shown in a schematic plan view in FIG. 22, across the discharge sustaining electrodes $X_A$ and $X_B$, protrusions 30*y* extending in a direction intersecting or orthogonal to the x-direction, for example, the y-direction are formed parallel with a specified interval corresponding to the disposition interval of the partition walls 18 formed on the second substrate 2 side mentioned later, and at the same time, intersecting with these protrusions 30*y*, intersecting protrusions 30*x* are formed to extend in the x-direction, thereby composing the crisscross protrusions 30.

The intersecting protrusions 30*x* are formed between the set of the discharge sustaining electrodes mentioned later, by straddling over or without straddling over a part of the discharge sustaining electrodes.

On the entire area of inner surface of the first substrate 1, a dielectric layer 16 made of $SiO_2$ or the like is formed, and further thereon, a surface layer 17 made of MgO or the like with a smaller work function is formed so as to protect the electrodes.

On the inner surface of the second substrate 2, a plurality of stripe partition walls 18 extending in y-direction are formed parallel.

The partition walls 18 are selected at the interval corresponding to the protrusions 30*y* of the protrusions 30 of the first substrate 1.

Excluding, for example, the tops of the partition walls 18, on the side surfaces thereof, the address electrode group Y forming address electrodes $Y_1$, $Y_2$, $Y_3$ . . . along the y-direction is formed. In the example shown in FIG. 21, the address electrodes Y ($Y_1$, $Y_2$, $Y_3$ . . . ) are formed between adjacent partition walls 18.

In the third embodiment, too, the discharge sustaining electrode group X is composed of first and second discharge sustaining electrodes $X_A$ and $X_B$, and their layout, pattern and so on are same as in the second embodiment, that is, the same layout and pattern as shown in FIG. 15 to FIG. 20. That is, also in this embodiment, a plurality of plasma discharge parts P are formed for one discharge sustaining electrode.

In the third embodiment, the interval between each address electrode Y ($Y_1$, $Y_2$, $Y_3$ . . . ) and the first discharge sustaining electrode $X_A$ is narrowed. That is, for example, in each address electrode Y ($Y_1$, $Y_2$, $Y_3$ . . . ), the interval between its edge at the side confronting the first substrate 1 at the side surface of the partition wall 18 and the fist discharge sustaining electrode $X_A$ is set at a narrow interval, that is, less than 50 $\mu$m, preferably 20 $\mu$m or less, and when starting discharge, mainly the cathode glow discharge is composed. The other points may be same as in the driving method of the second embodiment. That is, as explained in FIG. 9, for example, it may be designed to display about each horizontal scanning line by the first discharge sustaining electrode $X_A$ ($X_{A\text{-}12}$, $X_{A\text{-}34}$, $X_{A\text{-}56}$ . . . ) and the second discharge sustaining electrode $X_B$ ($X_{B\text{-}1}$, $X_{B\text{-}2}$ $X_{B\text{-}3}$ . . . ), or it is also possible to be driven by the interlacing, or in other method it is also possible to illuminate a plurality of plasma discharge parts simultaneously for one pixel.

An example of the embodiment of the manufacturing method of the flat display device according to the present invention is described below. This is an example of obtaining the flat display device in the constitution shown in FIG. 21, but the manufacturing method according to the present invention is not limited to this example alone.

First, an example of manufacturing method of the first substrate 1 side is described.

In this example, too, for example, a transparent conductive layer or metal layer to compose the first and second discharge sustaining electrodes $X_A$ and $X_B$ is formed on the entire area, and is subjected to the pattern etching by photolithography, whereby the desired pattern as shown in FIG. 15 to FIG. 20 is formed.

In this case, too, as required, bus electrodes are formed.

Later, by, for example, the printing method, the crisscross protrusions 30 consisting of the protrusions 30*y* and the intersecting protrusions 30*x* are formed, for example, in a height of 20 $\mu$m and width of 30 $\mu$m to 40 $\mu$m.

As mentioned above, thereafter, for example, by the CVD method, the dielectric layer 16 of $SiO_2$ is formed on the entire area, and for example, MgO is vapor-deposited to thereby form the surface layer 17 thereon.

An example of manufacturing method for the second substrate 2 is described while referring to FIG. 23 to FIG. 26 showing perspective views of parts in each step.

Figure 23A:
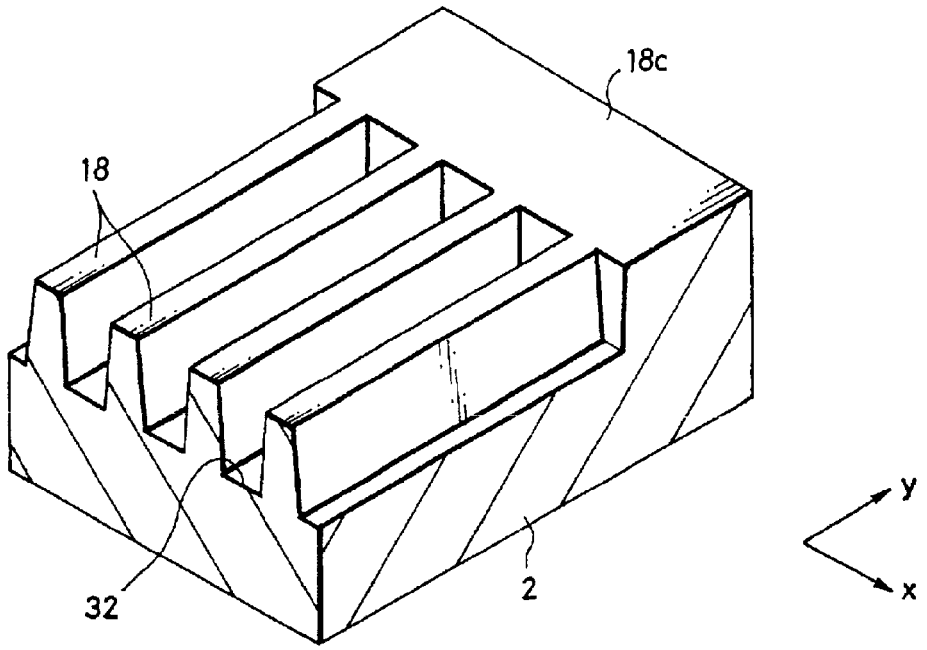
FIGS. 23A and 23B are perspective views of each manufacturing process of an example of manufacturing method of address electrodes in an example of flat type plasma a discharge display device according to the present invention.

In this case, first, as shown in FIG. 23A, preparing a second substrate 2 made of a glass substrate, the partition walls 18 extended in Y-direction and arranged parallel with a specific intervals in the X-direction are formed on the principal surface of the second substrate 2. A linkage part 18*c* is formed for mutually linking both ends of these partition walls 18 (only one end thereof is shown in FIG. 23A).

The partition walls 18 and the linkage parts 18*c* can be formed by the printing method. For example, glass paste is printed a plurality of times. In this case, the thickness of one printing is about 10 $\mu$m, and by repeating the printing, stripes of height (thickness) of 50 $\mu$m to 80 $\mu$m are printed. Afterward, the glass paste is baked at 500° C. to 600° C. As a result, the partition walls 18 of 30 $\mu$m to 60 $\mu$m in height is formed.

Then, at least at one side surface of the partition walls 18, excluding the tops of the partition walls 18, a conductive layer is formed and an address electrode is formed. In this example, address electrodes Y ($Y_1$, $Y_2$, $Y_3$ . . . ) are formed over both side surfaces of the partition walls 18, and the bottom of the groove 32 formed between the partition walls 18.

Figure 23B:
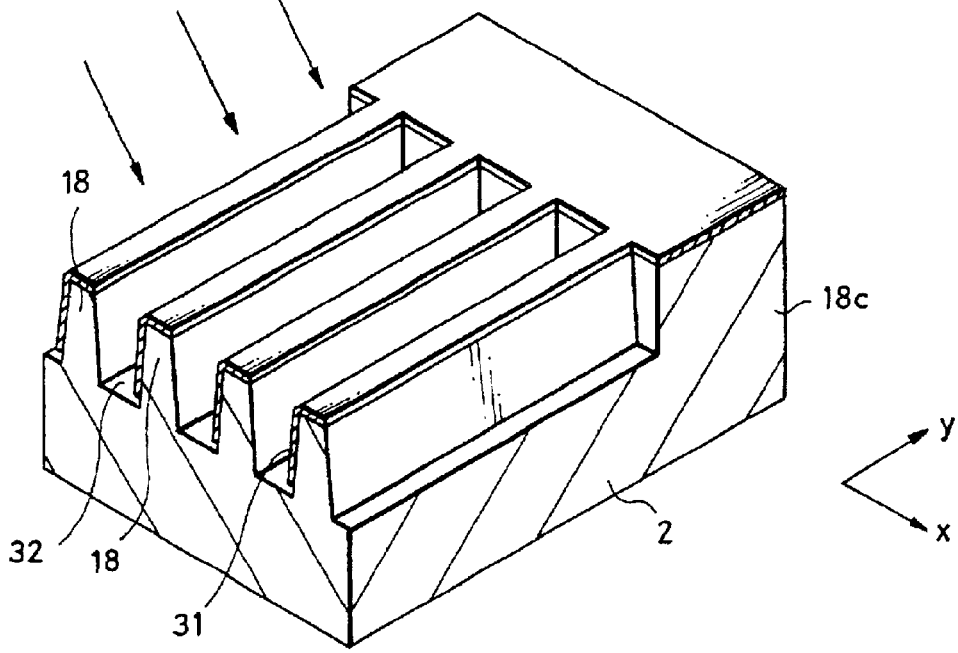

In this case, first as shown in FIG. 23B, for the partition walls 18 formed along the Y-direction, obliquely from above the one side surface corresponding to the partition wall 18 as schematically indicated by arrows, a conductive member 31 is deposited to cover mainly this one side surface.

Figure 24A:
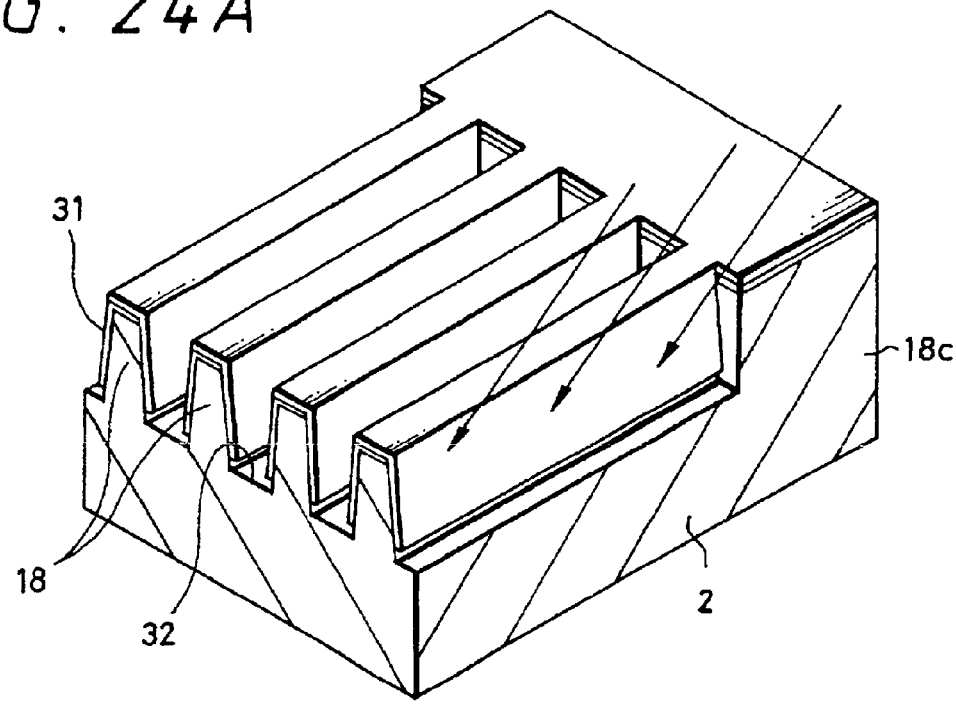
FIGS. 24A and 24B are perspective views of each manufacturing process of an example of manufacturing method of address electrodes in an example of flat type plasma a discharge display device according to the present invention.

Next, as schematically indicated by arrows in FIG. 24A, from obliquely above the other side surface of the partition wall 18, that is, from obliquely above the opposite side of the oblique above side shown in FIG. 23B, a conductive member 31 of, for example, Al is deposited by the vapor deposition method having a directivity in the flight direction, thereby covering mainly the other side surface of the partition wall 18.

Figure 24B:
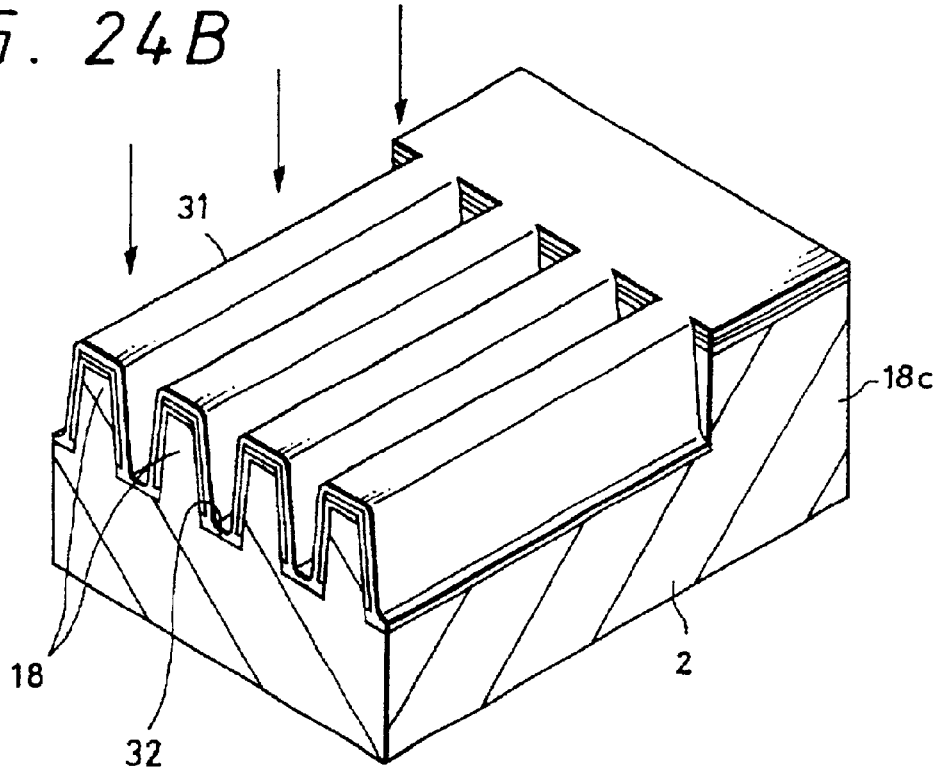

Further, as schematically indicated by arrows in FIG. 24B, the same conductive member 31 of Al or the like is sputtered from above the substrate 1 nearly along the vertical direction of the substrate surface, and the conductive member 31 is applied to cover the bottom of the groove 32 between the adjacent partition walls 18.

Figure 25A:
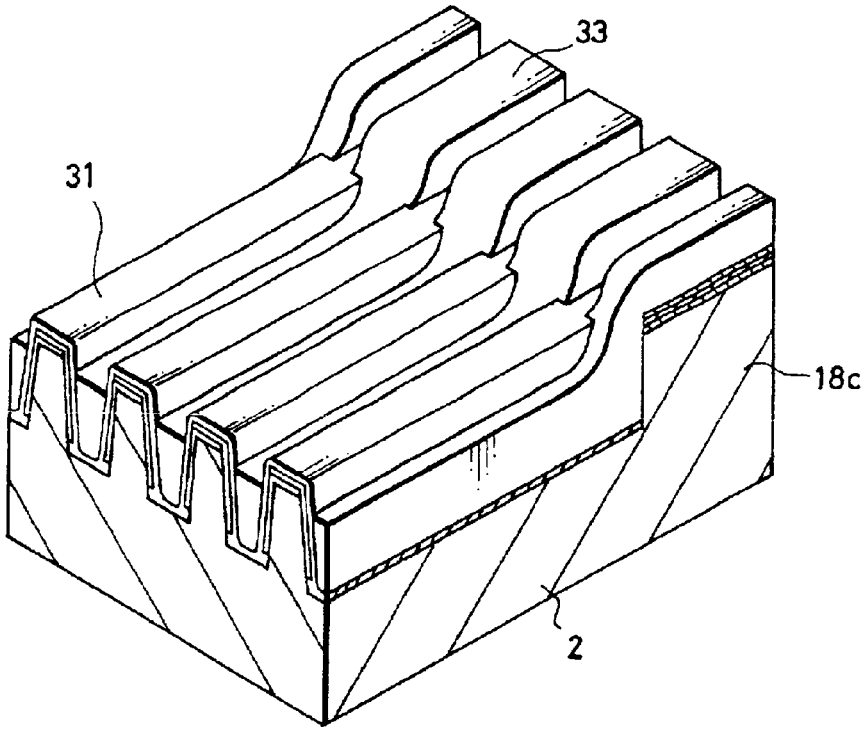
FIGS. 25A and 25B are perspective views of each manufacturing process of an example of manufacturing method of address electrodes in an example of flat type plasma a discharge display device according to the present invention.

As shown in FIG. 25A, thereafter, in each groove 32 and extending above the linkage part 18*c* therefrom, an etching resist 33 by a photo resist, for example, is formed in stripes by the photolithography.

In this case, the thickness of the etching resist 33 is selected as a thickness capable of exposing the conductive member 31 formed on the top of the partition wall 18 to the outside within the groove 32. Using this etching resist 33 as mask, next, by etching the conductive member 31, the conductive member 31 on the top of the partition wall 18 is removed over the linkage part 18*c*, and the conductive member 31 formed on both side surfaces of each partition wall 18 is electrically separated.

Figure 25B:
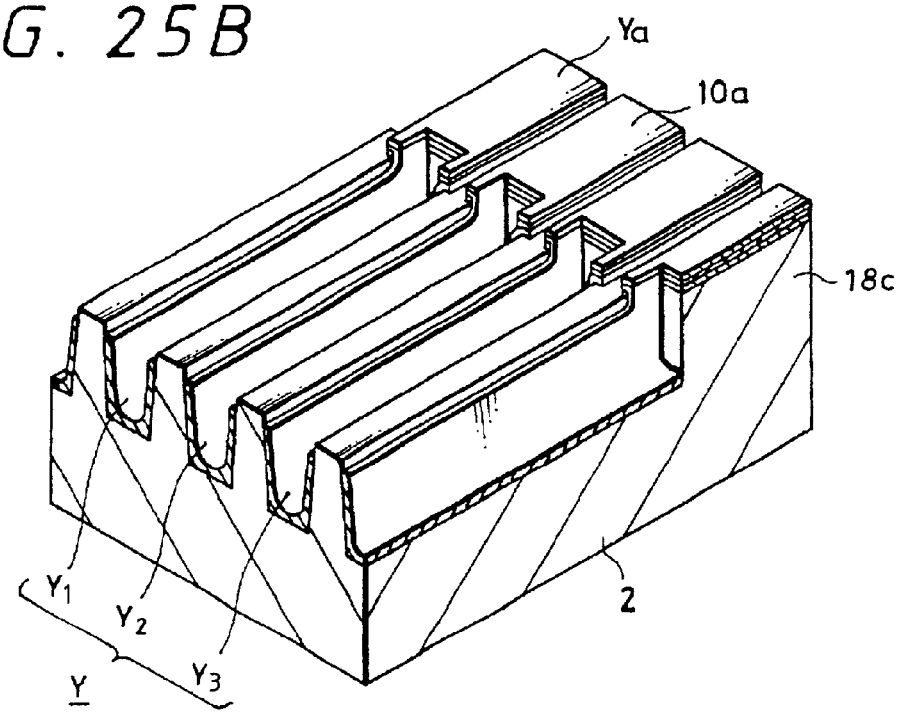

In this manner, as shown in FIG. 25B, the etching resist 33 is removed.

Thus, relating to each groove 32, the address electrode group Y is formed by the address electrodes Y ($Y_1$, $Y_2$, $Y_3$ . . . ) by the conductive member 31 formed on each bottom and at one side surface of each of the confronting partition wall 18 across the bottom.

In this case, terminals Ya extending on the linkage part 18*c* of the partition wall 18 can be formed at ends of the address electrodes $Y_1$, $Y_2$, $Y_3$ . . . , respectively.

In the example in FIG. 25B, all terminals Ya of the address electrodes $Y_1$, $Y_2$, $Y_3$, . . . are formed at the same ends, but, for example, at every other adjacent address electrodes Y, terminals may be led out from both ends of the groove 32.

Figure 26:
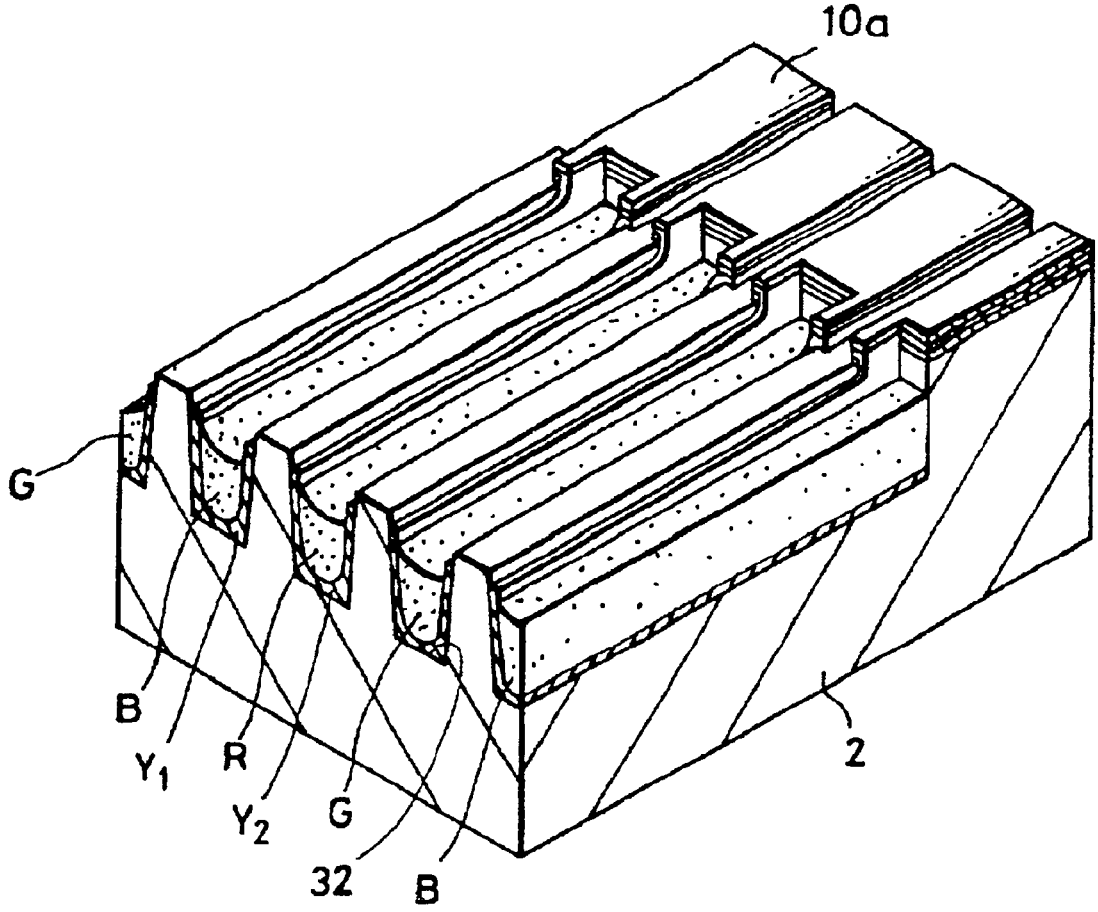
FIG. 26 is a perspective view of each manufacturing process of an example of manufacturing method of address electrodes in an example of flat type plasma a discharge display device according to the present invention.
Figure 27:
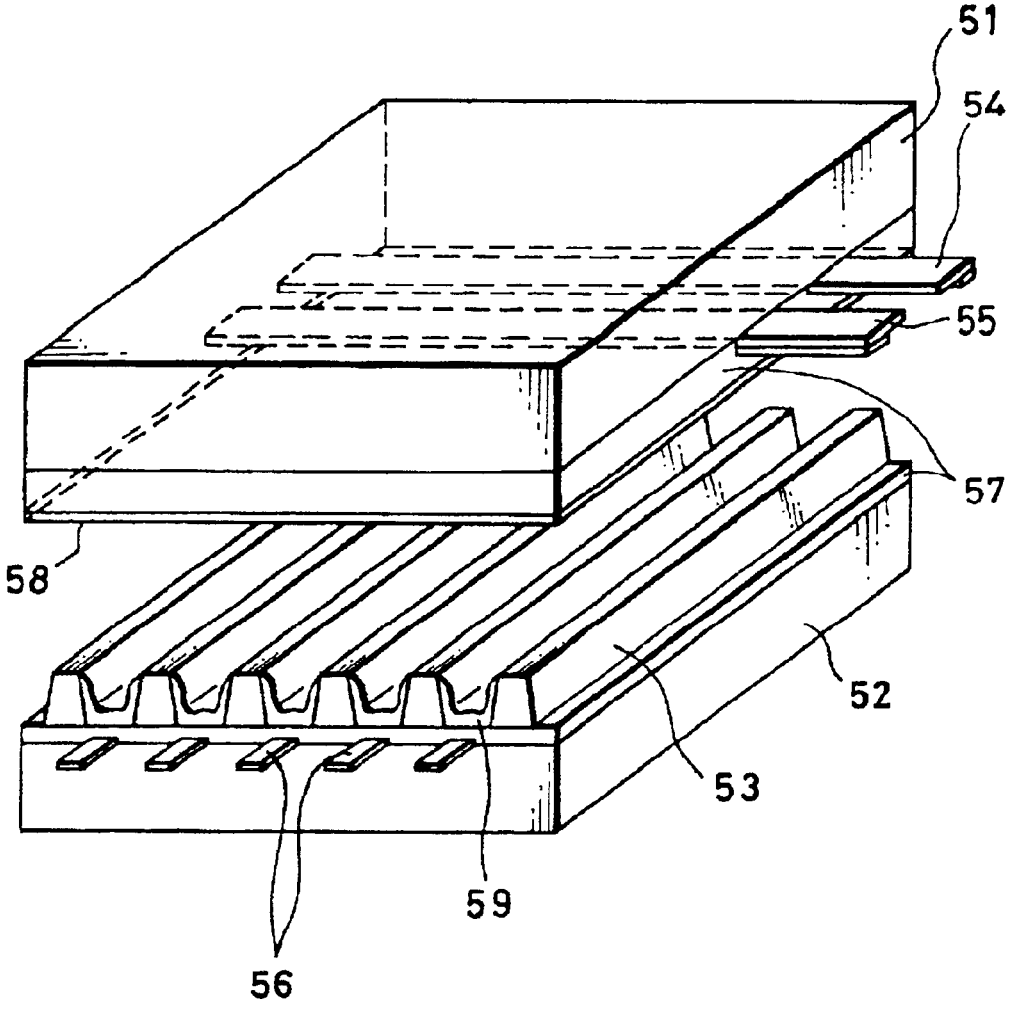
FIG. 27 is an exploded perspective view of a conventional flat type plasma a discharge display device.
Figure 28:
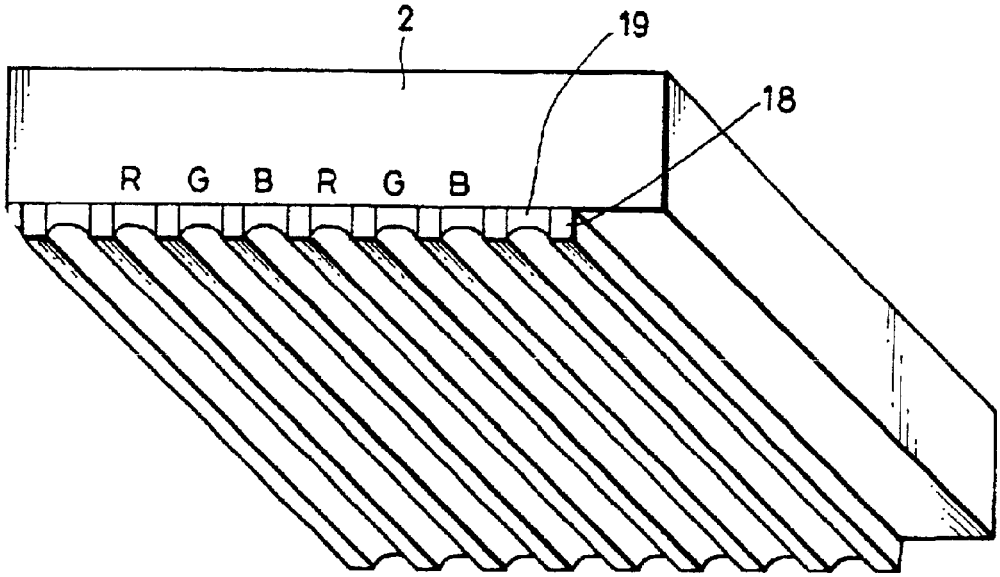
FIG. 28 is a partially cut-away essential perspective view of the flat type plasma a discharge display device compared with the device according to the present invention.
Figure 28:
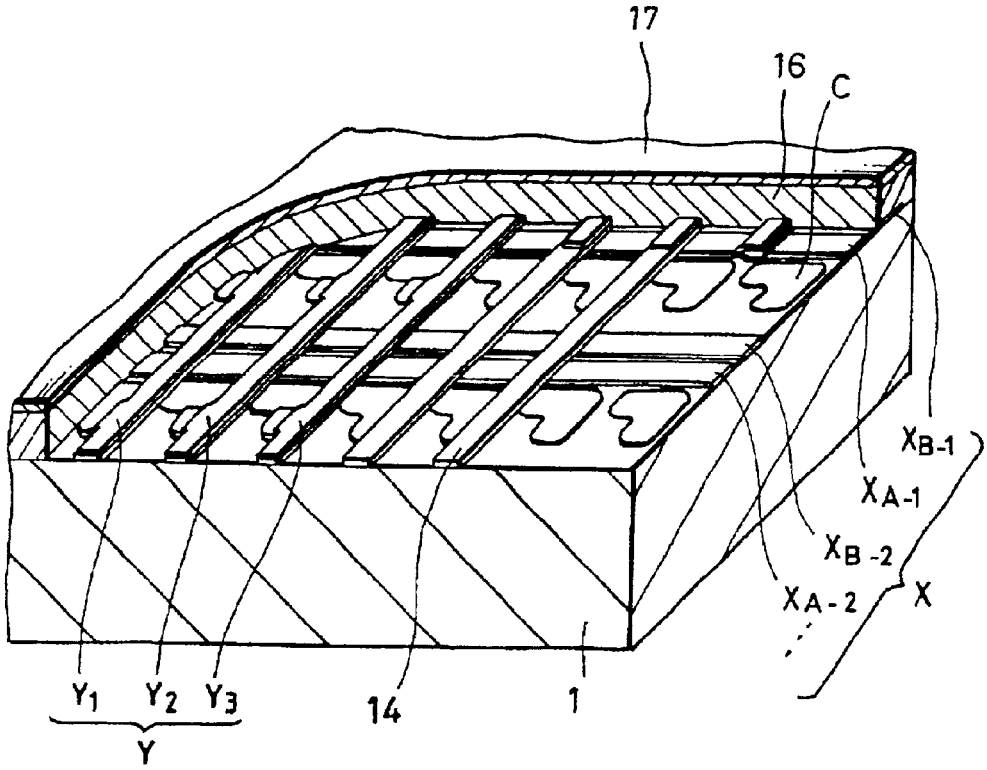
Figure 29:
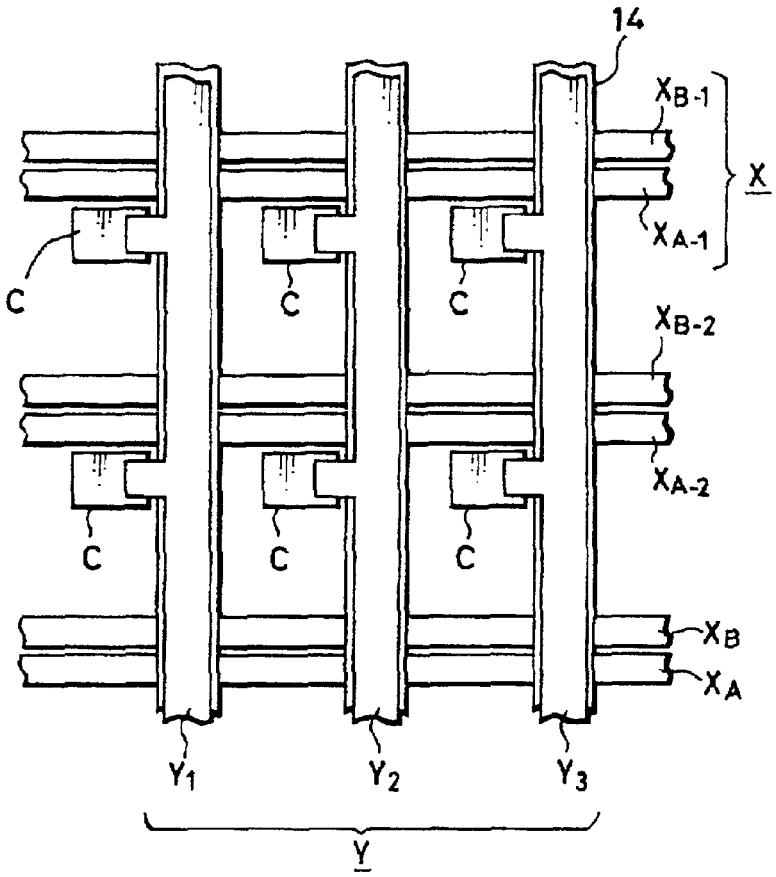
FIG. 29 is a plan view of essential parts of the flat type plasma a discharge display device shown in FIG. 27.
Figure 30:
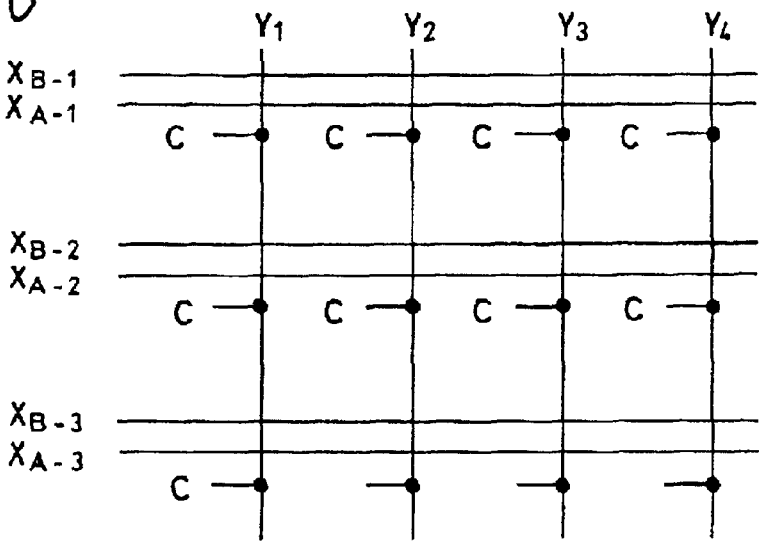
FIG. 30 is a schematic electrode layout diagram of the flat type plasma a discharge display device shown in FIG. 27.

As shown in FIG. 26, thereafter, in the groove 32 between the partition walls 18, by repeatedly coating and baking the photosensitive fluorescent slurry having fluorescent materials R, G, B of colors sequentially, red, green and blue fluorescent materials R, G, B are formed.

Further, as shown in FIG. 21, a surface layer 28 of MgO or the like is formed on the entire area.

In this way, the second substrate 2 is manufactured.

Thereafter, the first and second substrates 1 and 2 are placed face to face in the positional relation mentioned above, the peripheral parts thereof are fritted and sealed, and by evacuating and packing with the specified gas, the target or intended flat display device is obtained.

In this case, too, each of the electrode terminals is led out to the outside of the substrates 1 and 2 extended outside of the airtight space, whereby the current feed terminals are formed.

In the above-described example, each of the address electrodes Y ($Y_1$, $Y_2$, $Y_3$ . . . ) is formed over the inner side surface and the bottom of each of the grooves 32. When forming the address electrodes Y ($Y_1$, $Y_2$, $Y_3$ . . . ) thus in the bottoms of the grooves 32, these electrodes Y ($Y_1$, $Y_2$, $Y_3$ . . . ) function as light reflecting planes, and the emitted light is reflected behind the fluorescent materials R, G and B, and efficiently led forward from the front panel side, that is, the first substrate 1, so that a bright display may be realized. However, they may be also formed at one side surface only of the grooves 32, and in this case, the steps of FIGS. 24A and B can be omitted.

Alternatively, when forming the address electrodes Y ($Y_1$, $Y_2$, $Y_3$ . . . ) on both side surfaces only excluding the bottom of the grooves 32, the step of FIG. 24B can be omitted.

In this method, the partition walls 18 are formed in superimposing printing by repetition of pattern printing of glass paste, but alternatively, by printing the paste on the entire area in 50 to 80 $\mu$m, for example, and drying, a desired pattern may be formed by sand blasting. In this case, a mask for the sand blast is formed. To form the mask, a photosensitive film is laminated on the entire area, and it is exposed and baked in parallel stripes, and developed, and the mask of desired pattern is formed. Thereafter, by sand blasting through the opening of the mask, the glass layer of the undesired portion is removed, and then the photosensitive film is removed, and by baking at 500° C. to 600° C., the partition walls 18 of desired height may be formed.

In this example, the address electrodes Y ($Y_1$, $Y_2$, $Y_3$ . . . ) are formed within the grooves 32, but, for example, the address electrodes Y ($Y_1$, $Y_2$, $Y_3$ . . . ) of metal conductive layer may be formed by burying the same along the extending direction (y-direction) of the partition walls 18 or the like, that in, it is possible to form in various manners.

In the above-mentioned constitution, the partition walls 18 and the protrusions 30*y* of the crisscross protrusions 30 are abutted to each other through the dielectric layer and the surface layer in the illustrated example, and the interval between the first and second substrates 1 and 2 is selected by their height and thickness, and at the same time, the interval between the address electrodes Y ($Y_1$, $Y_2$, $Y_3$ . . . ) and the first discharge sustaining electrodes $X_A$ for starting the discharge therewith may be selected at a specified interval, in particular, the interval for generating the cathode glow discharge as mentioned above, that is, less than 50 $\mu$m, preferably 20 $\mu$m or less, for example, 10 $\mu$m.

By entrapping the discharge by collaboration of the protrusions 30*y* and the partition walls 18, discharge regions isolated from the others are formed, and in these regions, the pixel regions for emitting respective color lights are formed.

The airtight space formed by the first and second substrates 1 and 2 is evacuated and packed with the specified gas, such as gas of any one of He, Ne, Ar, Xe, or Kr, or a mixture gas of Ne and Xe, or so-called Penning gas, at a pressure capable of maintaining discharge of high luminance and high efficiency stably, for example, atmospheric pressure of 0.05 to 5.0.

In the third embodiment, both discharge sustaining and discharge start are composed mainly by the cathode glow discharge, so that the driving power may be further reduced as compared with the negative glow discharge.

As mentioned in the examples of the foregoing embodiments, when the discharge sustaining is effected mainly by the cathode glow discharge, that is, the discharge mode mainly by the cathode glow discharge, or further as in the third embodiment, when discharge start is also effected mainly by the cathode glow discharge, the driving power is reduced as mentioned above, and hence heat generation is decreased, and therefore use of the cooling fan can be avoided, or the number of cooling fans may be decreased or the power may be reduced, and hence the number and area of cooling fins can be saved, and the entire device can be reduced in size and weight in large-area display.

Alternatively, if the driving power is same or as large as in the prior art, the light emitting luminance can be enhanced.

As described herein, according to the flat type plasma a discharge display device and the driving method according to the present invention, a plurality of plasma discharge parts are formed for one discharge start part, but the constitution, driving method, and manufacturing method thereof are not limited to the illustrated examples alone, and various modifications and changes are made possible.

As clear from the description herein, in the flat type plasma a discharge display device according to the present invention, since a plurality of plasma discharge parts are formed for one discharge start part, the number of first discharge sustaining electrodes can be decreased, the constitution is simplified, the manufacture is easier thereby, and hence the incidence of defectives can be lowered, and also the reliability can be enhanced.

In the constitution of performing the discharge sustaining mainly by the cathode glow discharge, a high luminance is obtained, and further the driving power is saved. Further, when the discharge start is also mainly effected by the cathode glow discharge, the driving power is further saved. In the cathode glow discharge, since the interval between the electrodes is narrowed, the luminoust point can be made high definition and high density.

By decreasing the driving power, as mentioned above, the heat generation is decreased, so that the use of cooling fan may be avoided, or the number of cooling fans or the power may be reduced, and hence the number and area of cooling fins can be saved. As a result the entire device can be reduced in size and weight in large-area display, and many other benefits are obtained.

In addition, since a plurality of plasma discharge parts are formed for each discharge start part, as described above, the interlace driving may be done easily, and in this interlace driving method, since the signal processing circuit having memory function is not required, the circuit composition can be simplified.

By simultaneously operating a plurality of plasma discharge parts, moreover, luminous display of high luminance is easily achieved, and a sufficiently bright display is realized even in the large-screen flat type plasma a discharge display device.

Having described preferred embodiments according to the present invention with reference to the accompanying drawings, it is to be understood that the invention is not limited to those precise embodiments and that various changes and modifications could be effected therein by one skilled in the art without departing from the spirit or scope according to the present invention as defined in the appended claims.

What is claimed is:

1. A driving method of a flat type plasma discharge display device in which a discharge sustaining electrode group arranging a plurality of discharge sustaining electrodes and an address electrode group arranging a plurality of address electrodes are formed on a common substrate or on mutually different substrates, a plurality of plasma discharge parts are formed for one discharge start part of said address electrodes, an interval between each pair of discharge sustaining electrodes in discharge sustaining relating to each plasma discharge part is set at less than 50 $\mu$m, and a plasma discharge display mainly by a cathode glow discharge is realized, wherein a target or intended display is performed by making a portion between an address electrode of a discharge start part relating to a selected plasma discharge part and a discharge sustaining electrode in a discharge start state.

2. A driving method of a flat type plasma discharge display device as claimed in claim 1, wherein upon performing the intended display, as a driving method for forming one screen by first and second fields, in the first field, a display by a part of plasma discharge parts corresponding to each discharge start part is performed, and in the second field, a display by the other plasma discharge parts corresponding to each discharge start part is performed.

3. A driving method of flat type plasma discharge display device as claimed in claim 1, wherein upon performing the intended display, the intended display is made by driving and displaying a plurality of plasma discharge parts corresponding to the discharge start parts simultaneously.

4. A driving method of a flat type plasma discharge display device in which a discharge sustaining electrode group arranging a plurality of discharge sustaining electrodes and an address electrode group arranging a plurality of address electrodes each having a discharge start address electrode are formed on a common substrate, said discharge sustaining electrodes and said address electrodes are disposed to intersect each other through an insulating layer, and a plurality of plasma discharge parts are formed for each discharge start address electrode, wherein a target or intended display is performed by making a portion between a discharge start address electrode relating to a selected plasma discharge part and a discharge sustaining electrode in a discharge start state.

5. A driving method of a flat type plasma discharge display device as claimed in claim 4, wherein upon performing the intended display, as a driving method for forming one screen by first and second fields, in the first field, a display is made by a part of plasma discharge parts corresponding to each discharge start part, and in the second field, a display is made by the other plasma discharge parts corresponding to each discharge start part.

6. A driving method of a flat type plasma discharge display device as claimed in claim 4, wherein upon performing the intended display, a display is made by driving and discharging a pair of plasma discharge parts formed by the discharge start parts at the same time.

7. A driving method of a flat type plasma discharge display device in which a first substrate and a second substrate are opposed to each other while keeping a specified interval therebetween, a discharge sustaining electrode group formed by arranging a plurality of discharge sustaining electrodes is formed at said first substrate side, an address electrode group formed by arranging a plurality of address electrodes is formed at said second substrate side, a plurality of plasma discharge parts are formed in one discharge start part of said address electrodes, an interval between discharge sustaining electrodes forming a pair in discharge sustaining relating to said plasma discharge part is set at less than 50 $\mu$m, and a plasma discharge display mainly by a cathode glow discharge is realized, wherein a target or intended display is performed by making a portion between an address electrode of the discharge start part relating to a selected plasma discharge part and a discharge sustaining electrode in a discharge start state.

8. A driving method of a flat type plasma discharge display device as claimed in claim 7, wherein upon performing the intended display, as a driving method for forming one screen by first and second fields, in the first field, a display is made by a part of plasma discharge parts corresponding to each discharge start part, and in the second field, a display is made by the other plasma discharge part corresponding to each discharge start part.

9. A driving method of a flat type plasma discharge display device as claimed in claim 7, wherein upon performing the intended display, the intended display is made by driving and discharging a plurality of plasma discharge parts corresponding to the discharge start parts at the same time.

10. A driving method of a flat type plasma discharge display device in which a first substrate and a second substrate are opposed to each other while keeping a specified interval therebetween, a discharge sustaining electrode group formed by arranging a plurality of discharge sustaining electrodes is formed at said first substrate side, a plurality of partition walls extended in a direction intersecting with a main extending direction of said discharge sustaining electrodes while keeping a specified interval therebetween and an address electrode group composed of a plurality of address electrodes arranged and formed on each one of said partition walls along the extending direction of said partition walls are formed at said second substrate side, a plurality of plasma discharge parts are formed in one discharge start part of said address electrodes, an interval between discharge sustaining electrodes forming a pair in discharge sustaining relating to said plasma discharge part is set at less than 50 $\mu$m, and a plasma discharge display mainly by a cathode glow discharge is realized, wherein a target or intended display is made by making a portion between an address electrode relating to a selected plasma discharge part and a discharge sustaining electrode in a discharge start state.

11. A driving method of a flat type plasma discharge display device as claimed in claim 10, wherein upon performing the intended display, as a driving method for forming one screen by first and second fields, in the first field, a display is made by a part of plasma discharge parts corresponding to each discharge start part, and in the second field, a display is made by the other plasma discharge parts corresponding to each discharge start part.

12. A driving method of a flat type plasma discharge display device as claimed in claim 10, wherein upon performing the intended display, the intended display is made by driving and discharging a plurality of plasma discharge parts corresponding to the discharge start parts at the same time.

* * * * *